US006835519B2

(12) United States Patent
Sugiyama et al.

(10) Patent No.: US 6,835,519 B2
(45) Date of Patent: Dec. 28, 2004

(54) DRY TONER AND IMAGE FORMING METHOD USING SAME

(75) Inventors: Tsunemi Sugiyama, Numazu (JP); Shigeru Emoto, Numazu (JP); Hiroshi Yamashita, Numazu (JP); Masami Tomita, Numazu (JP); Kazuhito Watanabe, Yokohama (JP); Chiaki Tanaka, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/680,246

(22) Filed: Oct. 8, 2003

(65) Prior Publication Data

US 2004/0076900 A1 Apr. 22, 2004

Related U.S. Application Data

(63) Continuation of application No. 10/098,556, filed on Mar. 18, 2002, now Pat. No. 6,660,443.

(30) Foreign Application Priority Data

Mar. 19, 2001 (JP) ..... 2001-078824
Mar. 29, 2001 (JP) ..... 2001-095527
Sep. 21, 2001 (JP) ..... 2001-290141

(51) Int. Cl.[7] ..... G03G 9/087

(52) U.S. Cl. ..... 430/109.4; 430/108.1; 430/111.4; 430/137.17

(58) Field of Search ..... 430/109.4, 108.1, 430/111.4, 137.17, 108.4, 108.8, 110.1

(56) References Cited

U.S. PATENT DOCUMENTS 5,561,023 A 10/1996 Suzuki et al.
5,578,409 A 11/1996 Kotaki et al.
5,792,583 A 8/1998 Sano et al.
5,986,017 A 11/1999 Katagiri et al.
6,074,794 A 6/2000 Fushimi et al.
6,074,795 A 6/2000 Watanabe et al.
6,096,467 A 8/2000 Shimizu et al.
6,103,441 A 8/2000 Tomita et al.
6,140,000 A 10/2000 Yamashita
6,168,894 B1 1/2001 Aoki et al.
6,180,298 B1 1/2001 Kuroda et al.
6,221,549 B1 4/2001 Emoto et al.
6,255,028 B1 7/2001 Hasegawa et al.
6,335,137 B1 1/2002 Suzuki et al.
6,360,068 B1 3/2002 Kinoshita et al.
6,363,229 B1 3/2002 Shiraishi et al.
6,395,443 B2 5/2002 Kuroda et al.
6,403,275 B1 6/2002 Kuramoto et al.
6,406,826 B1 6/2002 Suzuki et al.
6,432,589 B1 8/2002 Uchinokura et al.
6,492,079 B2 12/2002 Shimada et al.
6,660,443 B2 12/2003 Sugiyama et al.

FOREIGN PATENT DOCUMENTS

EP 0 256 136 2/1988

*Primary Examiner*—John L Goodrow
(74) *Attorney, Agent, or Firm*—Oblon, Spivak, McClelland, Maier & Neustadt, P.C.

(57) ABSTRACT

A dry toner including at least a modified polyester as a toner binder, wherein the modified polyester has a main peak in a molecular weight region of 1000 to 30000 in a molecular weight distribution as measured by GPC, contains 1 to 10% of a component having a molecular weight of at least 30000, and has an Mw/Mn ratio of not greater than 15.

14 Claims, 1 Drawing Sheet

DRY TONER AND IMAGE FORMING METHOD USING SAME

This application is a Continuation application of U.S. application Ser. No. 10/098,556, filed on Mar. 18, 2002, now U.S. Pat. No. 6,660,443.

BACKGROUND OF THE INVENTION

The present invention relates to a toner for use in a developer for developing an electrostatic image in electrophotography, electrostatic recording, electrostatic printing and so on, and an image forming method using the toner, and more particularly, to a dry toner for use in an image forming apparatus, such as a copying machine, a laser printer or a plain paper facsimile machine, and an image forming method using the toner. Moreover, the present invention also relates to a dry toner for use in a full-color copying machine, a full-color laser printer and a full-color plain paper facsimile machine or the like image forming apparatus, and an image forming method using the toner.

A developer for use in electrophotography, electrostatic recording, electrostatic printing and so on is once adhered to an image carrier such as a photoconductor on which an electrostatic image has been formed in a developing process, then transferred from the photoconductor to a transfer medium such as a transfer paper in a transfer process, and fixed on the paper in a fixing process. As a developer for developing the electrostatic image formed on a latent image holding surface of the image carrier, a two-component developer comprising a carrier and a toner and a one-component developer requiring no carrier (magnetic or nonmagnetic toner) are known.

As a dry toner for use in electrophotography, electrostatic recording, electrostatic printing and so on, a toner obtained by melt-kneading a toner binder such as a styrene resin or a polyester together with a colorant and so on and finely pulverizing the kneaded mixture is conventionally used.

After having been developed and transferred to a paper or the like, such a dry toner is heat-melted and fixed with a heat roll. At this time, when the temperature of the heat roll is excessively high, the toner is excessively melted and adhered to the heat roll (hot offset). When the temperature of the heat roll is excessively low, the toner is not sufficiently melted, resulting in insufficient fixation. With a view to energy saving and downsizing of an apparatus such as a copying machine, a toner which does not cause hot offset at a high fixing temperature (namely, has hot offset resistance) and which can be fixed at a low fixing temperature (namely, has low temperature fixability) is demanded. The toner should also have heat-resistant preservability so as not to cause blocking during storage or under ambient temperature in an apparatus in which the toner is used. Especially, a toner for use in a full-color copying machine and a full-color printer need to have a low melt viscosity to provide gloss and color mixability in a printed image, so that a polyester type toner binder having a sharp melt property is used therein. Since such a toner is likely to cause hot offset, a silicone oil or the like is conventionally applied to a heat roll in full-color machines. However, in order to apply a silicone oil to a heat roll, an oil tank and an oil applying unit are necessary, which makes the apparatus unavoidably complicated and large. Also, application of oil causes deterioration of the heat roll, so that the heat roll requires regular maintenance. Additionally, it is unavoidable for the oil to adhere a copying paper and an OHP (overhead projector) film. Especially, the oil adhered to OHP film impairs color tone of a printed image.

For the purpose of producing an image with high fineness and high quality, improved toners having a small particle size or a narrow particle size distribution have been proposed. However, particles of a toner produced by a normal kneading-pulverizing method have irregular shapes. Thus, the toner particles are further pulverized to generate superfine particles or a fluidizing agent is buried in the surface of the toner particles when the toner is agitated with a carrier in a developing unit or when, in the case of being used as a one-component developer, the toner particles receive a contact stress from a developing roller, a toner supply roller, a layer thickness regulating blade, a frictional electrification blade and so on, resulting in deterioration of image quality. Also, the toner is poor in fluidity as a powder because of the irregular shapes of the particles thereof, and thus requires a large amount of fluidizing agent or cannot be filled in a toner bottle with a high filling rate, which hinders downsizing of the apparatus.

Additionally, a process of transferring an image formed of color toners to produce a full-color image from a photoconductor to a transfer medium or a paper is becoming more complicated, so that low transferability of a pulverized toner due to the irregular shapes of the particles thereof causes a void in a transfer image and an increase in consumption of toners to prevent it.

Thus, there is an increasing demand for reducing toner consumption without causing a void in a transferred image by improving transfer efficiency and for decreasing running cost. When transfer efficiency is significantly high, there is no need for a cleaning unit for removing untransferred toner from a photoconductor and a transfer medium, which leads to downsizing of the apparatus and cost reduction in manufacturing the same. This has also a merit of generating no waste toner. For the purpose of overcoming the drawbacks of the toner of irregular particle shape, there has been proposed various methods for producing spherical toner particles.

For the purpose of providing a toner having heat-resistant preservability, low-temperature fixability and hot offset resistance, there have been proposed (1) a toner in which a polyester partially crosslinked using a multifunctional monomer is used as a toner binder (Japanese Laid-Open Patent Publication No. S57-109825) and (2) a toner in which a urethane-modified polyester is used as a toner binder (Japanese Examined Patent Publication No. H07-101318). For the purpose of providing a toner for use in a full-color system which can reduce the amount of oil to be applied to the heat roll, (3) a toner produced by granulating polyester fine particles and wax fine particles is proposed (Japanese Laid-Open Patent Publication No. H07-56390). Proposed for the purpose of providing a toner having improved powder fluidity and transferability when its particle size is reduced are (4) a polymerized toner obtained by dispersing a vinyl monomer composition containing a colorant, a polar resin and a releasing agent in water and suspension-polymerizing the vinyl monomer composition (Japanese Laid-Open Patent Publication No. H09-43909) and (5) a toner obtained by sphering toner particles comprising a polyester type resin in water using a solvent (Japanese Laid-Open Patent Publication No. H09-34167).

Additionally, Japanese Laid-Open Patent Publication No. H11-133666 discloses a dry toner consisting of nearly spherical particles in which a polyester modified with urea a bond is used.

However, none of the toners (1) to (3) have sufficient powder fluidity and transferability and thus can produce a high-quality image even when its particle size is reduced. The toners (1) and (2) cannot compatibly satisfy the heat-resistant preservability and the low temperature fixability and do not develop sufficient gloss to be used in a full color system. The toner (3) is insufficient in the low-temperature fixability and the hot offset resistance in oilless fixation. The toners (4) and (5) are improved in the powder fluidity and the transferability. However, the toner (4) is insufficient in the low-temperature fixability and requires much energy to fix. This problem is pronounced when the toner is used in full-color printing. The toner (5), which is superior to the toner (4) in the low-temperature fixability, is insufficient in hot offset resistance and thus cannot preclude the necessity of the application of oil to the heat roll in a full-color system.

The toner (6) is excellent in that the viscoelasticity of the toner can be appropriately adjusted by using a polyester extended by a urea bond and that it can compatibly satisfy gloss and releasing property as a full-color toner. Especially, a phenomenon in which a fixing roller is electrified in use and unfixed toner on a transfer medium is electrostatically scattered or adhered to the fixing roller, namely, electrostatic offset can be reduced by neutralization between positive chargeability of the urea bond component and weakly negative chargeability of the polyester resin. However, the molecular weight distribution of the urea-extended polyester is not controlled and an appropriate molecular weight distribution to satisfy releasing property and gloss/transparency which conflict with each other in a color toner in oilless fixation has not been found.

SUMMARY OF THE INVENTION

It is, therefore, an object of the present invention to provide a dry toner which is excellent in powder fluidity and transferability when its particle size is reduced and in heat-resistant preservability, low-temperature fixability and hot offset resistance.

Another object of the present invention is to provide a dry toner which can produce high gloss in a printed image and does not require application of oil to a heat roll when used in a full-color copying machine or the like.

It is a further object of the present invention to provide an image forming method using the above dry toner.

As a result of earnest studies for solving the above problems, the present inventors have made the present invention.

In accordance with the present invention, there is provided a dry toner for developing an electrostatic image, comprising a toner binder comprising a modified polyester having such a molecular weight distribution according to gel permeation chromatography that (a) a main peak is present in a molecular weight region of 1000 to 30,000, (b) that portion of the modified polyester having a molecular weight of at least 30,000 accounts for 1 to 10% based on a total weight of the modified polyester and (c) a ratio (Mw/Mn) of the weight average molecular weight Mw of the modified polyester to the number average molecular weight Mn of the modified polyester is not smaller than 2 but not greater than 15.

In another aspect, the present invention provides a dry toner for developing an electrostatic image having a melt viscosity at 110° C. of $2.0\times10^3$ to $2.0\times10^4$ Pa·s and a melt viscosity at 130° C. of $2.0\times10^3$ or less and providing such a fixed image on an overhead projector sheet that has a deposition amount of 0.8–1.2 mg/cm$^2$ and has a contact angle to water of 90°–130°.

BRIEF DESCRIPTION OF THE DRAWINGS

Other objects, features and advantages of the present invention will become apparent from the detailed description of the preferred embodiments of the invention which follows, when considered in the light of the accompanying drawing, in which.

DETAILED DESCRIPTION OF THE PREFERRED EMBODIMENTS OF THE INVENTION

Figure 1:
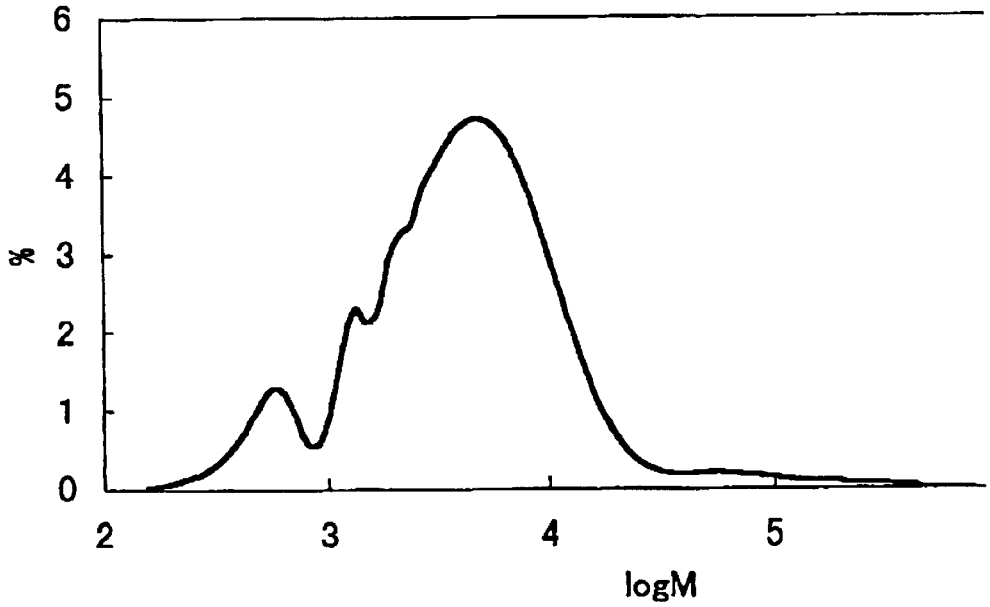
FIG. 1 is a GPC chromatograph of a toner binder obtained in Example 1.

A toner, a full-color toner, in particular, is desired to have properties such as color reproducibility, transparency and gloss in addition to heat-resistant preservability, low-temperature fixability and hot offset resistance.

One of the typical methods to provide a toner with low-temperature fixability and hot offset resistance is a method in which a resin having a wide molecular weight distribution is used as a binder resin. Another method is a method in which a resin mixture containing at least a high molecular weight component having a molecular weight of several hundreds thousand and a low molecular weight component having a molecular weight of several thousands is used so that each of the components may serve different functions. In this case, the high molecular weight component has good effect on the hot offset resistance when it has a crosslinked structure or is in the form of a gel.

On the other hand, in order to attain transparency and gloss, the toner should have the smallest possible molecular weight and a sharp molecular weight distribution. Thus, it is difficult to provide a toner with the conflicting characteristics by the above methods.

In the toner of the present invention, both low-temperature fixability and hot offset resistance ar obtained by using a toner binder containing a modified polyester which has a main peak in a low molecular weight region of 1000 to 30000 and which contains 1 to 10% of a high molecular weight component having a molecular weight of at least 30000. The reason why the content of the high molecular weigh component is relatively small is that the modifying groups in the modified polyester (portions of bonding groups other than an ester bond) are bonding groups having a strong cohesive force such as a hydrogen bond. By controlling the cohesive force, resin characteristics which cannot be controlled by the molecular weight or the crosslinking degree thereof can be controlled. Thus, satisfactory hot offset resistance can be imparted to the toner without adding a large amount of a high molecular weight component which impairs the transparency and gloss of the toner.

When most of the modified polyester comprises a low molecular weight component having a molecular weight of not greater than 30000 and a sharp molecular weight distribution with an Mw/Mn ratio of not smaller than 2 but not greater than 15, preferably not smaller than 2 but not greater than 5, the resulting toner can have satisfactory gloss/transparency.

The toner of the present invention is also excellent in color reproducibility. This is because the modifying groups in the modified polyester are easily adsorbed to a pigment and thus allows high dispersion of the pigment.

According to the present invention, a toner including particles having a spherical shape, a small particle size and a sharp particle size distribution which can realize high image quality and high transferability can be obtained by a method comprising the steps of (a) dissolving or dispersing a toner composition comprising at least a prepolymer and a colorant in an organic solvent to prepare a liquid, (b)

dispersing the liquid obtained in step (a) in an aqueous medium in the presence of an inorganic dispersant or a powdery polymer to obtain a dispersion, (c) subjecting the dispersion obtained in step (b) to a polyaddition reaction to polymerize the prepolymer and to prepare a reaction mixture, and (d) removing the solvent from the reaction mixture.

When a prepolymer is used, the high molecular weight component can be generated though the process of dispersing it in the aqueous medium, a washing process, an aging process, a drying process and so on. Thus, a high molecular weight polyester insoluble in an organic solvent can be contained in the toner binder. This means that a wide variety of resins can be used and that the molecular weight of the modified polyester can be controlled with ease. Also, when the toner composition is dissolved in the organic solvent, the prepolymer does not increase the viscosity of the solution very much, so that emulsification and dispersion in the aqueous medium is facilitated.

The toner of the present invention is also excellent in heat-resistant preservability because of the presence of the modifying groups. Especially in the toner produced by dispersing the toner composition in the aqueous medium, it is thought that much of the modified polyester having high polarity is present in an area adjacent to the surface of each toner particle because of its hydrophobicity and forms a pseudo-capsule structure in which the high molecular weight component covers the low molecular weight component. This prevents blocking of the toner during storage and improves the heat-resistant preservability thereof.

The toner of the present invention has above characteristics.

The molecular weight distribution of the modified polyester component in the toner binder of the present invention is measured according to the following method using GPC.

About 1 g of the toner is charged in an Erlenmeyer flask and 10 to 20 g of THF (tetrahydrofuran) is added thereto to prepare a THF solution having a binder concentration of 5 to 10%. A column is stabilized within a heat chamber set at 40° C., and THF as a solvent is passed through the column at this temperature at a rate of 1 ml/min. Then, 20 $\mu$l of the sample solution is injected into the column. The molecular weight of the sample is calculated from the relation between the logarithm of a calibration curve obtained using a monodispersion polystyrene standard sample and the retention time. As the monodispersion polystyrene standard sample, for example, a polystyrene having a molecular weight between $2.7\times10^2$ and $6.2\times10^6$ made by Toso Co., Ltd. is used. As a detection device, a refraction index (RI) detector is used. Examples of the column include TSK gel, G1000H, G2000H, G2500H, G3000H, G4000H, G5000H, G6000H, G7000H and GMH, products of Toso Co., Ltd. Those columns are used in combination.

It is important that the modified polyester have a such a molecular weight distribution according to gel permeation chromatography GPC (calibrated by polystyrene standards) providing a main peak in a molecular weight region of 1,000 to 30,000. The main peak molecular weight of the modified polyester is preferably 1,500 to 10,000, more preferably 2,000 to 8,000. When the main peak molecular weight is less than 1,000, the resulting toner has poor heat-resistant preservability. When the main peak molecular weight is over 30,000, the resulting toner has poor low-temperature fixability. The content of the component having a molecular weight of not smaller than 30,000 is 1 to 10%, preferably 3 to 6%. When the content is less than 1%, the resulting toner cannot have satisfactory hot offset resistance. When the content is over 10%, the resulting toner has poor transparency and gloss. The modified polyester has an Mw/Mn ratio (a ratio of the weight average molecular weight Mw of the modified polyester to the number average molecular weight Mn of the modified polyester) of not smaller than 2 but not greater than 15, preferably not smaller than 2 but not greater than 5. When the Mw/Mn ratio is over 15, the resulting toner will be lacking in sharp melt property and has poor gloss.

The modified polyester used as a binder is (A) a polyester resin containing one or more groups other than (a) the functional groups of the monomer units (diol units and dicarboxylic acid units from which the polyester is constructed) and (b) the ester linkages of the polyester, or (B) a polyester resin to which a different polymer is bonded through ionic bonding or covalent bonding.

Thus, the modified polyester may be a polyester whose terminus is modified with a functional group, such as an isocyanate group, capable of reacting with a carboxylic or hydroxyl group. The functional group may be further reacted with a compound having one or more active hydrogen atoms. In this case, when the compound has a plurality of active hydrogen (such as diamines and diols), two or more polyesters are linked together. Urea-modified polyester and urethane-modified polyester are illustrative of such modified polyesters.

The modified polyester may also be a graft polymer-modified or cross-linked polyester obtained by introducing a reactive group such as an unsaturated group. The unsaturated group thus introduced is further reacted by, for example, radical polymerization to form graft side chain or chains. Alternatively, two such unsaturated groups may be cross-linked. Styrene-modified polyester and acryl-modified polyester are illustrative of such modified polyesters.

Further, the modified polyester may be a polyester which is copolymerized or reacted with another resin. One example of such a modified polyester is a silicone-modified polyester obtained by reacting a polyester with a silicone resin whose terminus has been modified with a carboxyl group, hydroxyl group, epoxy group or mercapto group.

Preferably used as the modified polyester is a urea-modified polyester of which description will be next made in detail.

The urea-modified polyester may be suitably prepared by reacting an isocyanate-containting polyester prepolymer with an amine. The isocyanate-containting polyester prepolymer may be obtained by reacting a polyisocyanate with a polyester which is prepared by polycondensation of a polyol with a polyacid and which has an active hydrogen. Examples of active hydrogen-containing groups include a hydroxyl group (alcoholic OH or phenolic OH), an amino group, a carboxyl group and a mercapto group.

The polyol may be a diol or a tri- or more polyhydric alcohol. A mixture of a diol with a minor amount of a tri- or more polyhydric alcohol is preferably used.

As the diol to be used for the preparation of the base polyester, any diol employed conventionally for the preparation of polyester resins can be employed. Preferred examples include alkylene glycols such as ethylene glycol, 1,2-propylene glycol, 1,3-propylene glycol, 1,3-butylene glycol, 1,4-butylene glycol, 2,3-butanediol, diethylene glycol, triethylene glycol, dipropylene glycol, 1,5-pentanediol, 1,6-hexanediol, neopentyl glycol and 2-ethyl-1,3-hexanediol; alkyleneether glycols such as diethylene glycol, triethylene glycol, dipropylene glycol, polyethylene glycol, polypropylene glycol and polytetramethylene ether glycol; alicyclic glycols such as 1,4-cyclohexane dimethanol and hydrogenated bisphenol A; bisphenols such as bisphenol A, bisphenol F and bisphenol S; alkylene oxide adducts (e.g. ethylene oxide, propylene oxide and butylene oxide adducts) of the above alicyclic diols; and alkylene oxide adducts (e.g. ethylene oxide, propylene oxide and butylene oxide adducts) of the above bisphenols. Above all, alkylene glycols having 2–12 carbon atoms and alkylene oxide adducts of bisphenols are preferred. Especially preferred is the use of a mixture of alkylene glycols having 2–12 carbon atoms with alkylene oxide adducts of bisphenols.

Examples of the polyol having three or more hydroxyl groups include polyhydric aliphatic alcohols such as glycerin, 2-methylpropane triol, trimethylolpropane, trimethylolethane, pentaerythritol, sorbitol and sorbitan; phenol compounds having 3 or more hydroxyl groups such as trisphenol PA, phenol novolak and cresol novolak; and alkylene oxide adducts of the phenol compounds having 3 or more hydroxyl groups.

The polyacid may be a dicarboxylic acid, tri- or more polybasic carboxylic acid or a mixture thereof.

As the dicarboxylic acid to be used for the preparation of the base polyester, any dicarboxylic acid conventionally used for the preparation of a polyester resin can be employed. Preferred examples include alkyldicarboxylic acids such as malonic acid, succinic acid, glutaric acid, adipic acid, azelaic acid and sebacic acid; alkenylene dicarboxylic acids such as maleic acid, fumaric acid, citraconic acid and itaconic acid; and aromatic dicarboxylic acids such as phthalic acid, terephthalic acid, isophthalic acid and naphthalene dicarboxylic acid. Above all, alkenylene dicarboxylic acids having 4–20 carbon atoms and aromatic dicarboxylic acids having 8–20 carbon atoms are preferably used.

Examples of tri- or more polybasic carboxylic acids include aromatic polybasic carboxylic acids having 9–20 carbon atoms such as trimellitic acid and pyromellitic acid.

The polyacids may be in the form of anhydrides or low alkyl esters (e.g. methyl esters, ethyl esters and isopropyl esters).

In the formation of the polyester, the polyacids and the polyols are used in such a proportion that the ratio [OH]/[COOH] of the equivalent of the hydroxyl groups [OH] to the equivalent of the carboxyl groups [COOH] is in the range of generally 2:1 to 1:1, preferably 1.5:1 to 1:1, more preferably 1.3:1 to 1.02:1.

Examples of the polyisocyanate compound reacted with the polyester include aliphatic polyisocyanates such as tetramethylene diisocyanate, hexamethylene diisocyanate and 2,6-diisocyanate methylcaproate; alicyclic polyisocyanates such as isophorone diisocyanate, cyclohexylmethane diisocyanate; aromatic diisocyanate such as xylylene diisocyanate, tolylene diisocyanate, diphenylmethane diisocyanate and $\alpha,\alpha,\alpha',\alpha'$-tetramethylxylylene diisocyanate; isocyanurates; the above polyisocyanates blocked or protected with phenol derivatives, oximes or caprolactams; and mixtures thereof.

The polyisocyanate is used in such an amount that the ratio [NCO]/[OH] of the equivalent of the isocyanate groups [NCO] to the equivalent of the hydroxyl groups [OH] of the polyester is in the range of generally 5:1 to 1:1, preferably 4:1 to 1.2:1, more preferably 2.5:1 to 1.5:1. A [NCO]/[OH] ratio of over 5:1 tends to adversely affect low temperature fixation properties of the resulting toner. Too small a [NCO]/[OH] ratio of less than 1 tends to adversely affect anti-hot offset properties of the resulting toner.

The isocyanate group-containing polyester prepolymer generally has a content of the polyisocyate unit in the range of 0.5–40% by weight, preferably 1–30% by weight, more preferably 2–20% by weight. Too small an isocyanate group content of less than 0.5% tends to adversely affect anti-hot offset properties and to pose a difficulty in simultaneously obtaining satisfactory low temperature fixation properties and heat-resisting preservability of the resulting toner. When the isocyanate group content exceeds 40% by weight, the low temperature fixation properties of the resulting toner tends to be adversely affected.

The average number of the isocyanate groups contained in the prepolymer molecule is generally at least 1, preferably 1.5–3, more preferably 1.8–2.5. Too small a isocyanate group number less than 1 will result in a urea-modified polyester having an excessively small molecular weight so that the anti-hot offset properties of the toner will be adversely affected.

Examples of the amine to be reacted with the isocyanate group-containing polyester prepolymer for the formation of the urea-modified polyester include diamines, polyamines having 3 or more amino groups, aminoalcohols, aminomercaptans, amino acids and blocked or protected derivatives thereof.

Illustrative of suitable diamines are aromatic diamines such as phenylenediamine, diethytoluenediamine and 4,4'-diaminodiphenylmethane; alicyclic diamines such as 4,4'-diamino-3,3-dimethylcyclohexylmethane, diaminocyclohexane and isophoronediamine; and aliphatic diamines such as ethylenediamine, tetramethylenediamine and hexamethylenediamine. Illustrative of suitable polyamines having 3 or more amino groups are diethylenetriamine and triethylenetetramine. Illustrative of suitable aminoalcohols are ethanolamine and hydroxyethylaniline. Illustrative of suitable aminomercaptans are aminoethylmercaptan and aminopropylmercaptan. Illustrative of suitable amino acids are aminopropionic acid and aminocaproic acid. Illustrative of suitable blocked derivatives of the above diamines, polyamines having 3 or more amino groups, aminoalcohols, aminomercaptans and amino acids are ketimines obtained by interacting the amines with a ketone such as acetone, methyl ethyl ketone or methyl isobutyl ketone. Oxazolidine compounds may be also used as the blocked derivatives. Especially preferred amine is an aromatic diamine or a mixture of an aromatic diamine with a minor amount of a polyamine having 3 or more amino groups.

If desired, a chain extension terminator may be used to control the molecular weight of the urea-modified polyester. Examples of the chain extension terminators include monoamines such as diethylamine, dibutylamine, butylamine and laurylamine. Blocked or protected monomines such as ketimines may be also used as the terminator.

The amine is reacted with the isocyanate group-containing polyester prepolymer in such an amount that the ratio [NCO]/[$NH_x$] of the equivalent of the isocyanate groups [NCO] of the prepolymer to the equivalent of the amino groups [$NH_x$] of the amine is in the range of generally 1:2 to 2:1, preferably 1.5:1 to 1:1.5, more preferably 1.2:1 to 1:1.2. A [NCO]/[$NH_x$] ratio over 2:1 or less than 1:2 will result in a urea-modified polyester having an excessively small molecular weight so that the anti-hot offset properties of the toner will be adversely affected.

One specific example of a method of producing the urea-modified polyester is as follows. A polyol and a polyacid are reacted with each other in the presence of an esterification catalyst such as tetrabutoxytitanate or dibutyltin oxide at a temperature of 150–280° C. The reaction may be carried out under a reduced pressure while removing water produced in situ, if desired. The resulting hydroxyl group-containing polyester is reacted with a polyisocyanate at 40–140° C. in the presence or absence of a solvent to obtain an isocyanate-containing prepolymer. The prepolymer is reacted with an amine at 0–140° C. in the presence or absence of a solvent to obtain a urea-modified polyester. Any solvent inert to the polyisocyanate may be used. Examples of the solvents include aromatic solvents such as toluene and xylene; ketones such as acetone, methyl ethyl ketone and methyl isobutyl ketone; esters such as ethyl acetate; amides such as dimethylformamide and dimethylacetamide; and ethers such as tetrahydrofuran.

The urea-modified polyester may contain an urethane linkage, if desired. The content of the urethane linkage is generally up to 90 mole %, preferably up to 80 mole %, more preferably up to 70 mole %, based on total of the urethane and urea linkages. Too large an amount of the urethane linkage above 90 mole % may adversely affect the anti-hot offset properties of toner.

The modified polyester used in the present invention may be prepared by one-shot method or a prepolymer method. The modified polyester generally has a weight average molecular weight of at least 10,000 preferably 20,000 to $10^7$, more preferably 30,000 to $10^6$. Too small a weight average molecular weight of less than 10,000 may adversely affect the anti-hot offset properties of toner. When the modified polyester is used by itself as the binder, the number average molecular weight thereof is generally 20,000 or less, preferably 1000–10,000, more preferably 2,000–8,000. Too large a number average molecular weight above 20,000 may adversely affect low temperature fixation properties of the resulting toner and gloss of color toner images. When the modified polyester is used in conjunction with a non-modified polyester as the toner binder, however, the number average molecular weight thereof is not specifically limited but may be arbitrarily determined in view of the above weight average molecular weight.

It is preferred that the modified polyester be used in conjunction with a non-modified polyester as the toner binder for reasons of low temperature fixation properties of the toner and improved gloss of the toner images. The non-modified polyester may be polycondensation products obtained from polyols and polyacids. Suitable polyols and polyacids are as described previously with reference to the modified polyester. The amount of the non-modified polyester in the toner binder is such that the weight ratio of the modified polyester to the non-modified polyester is generally 5:95 to 80:20, preferably 5:95 to 30:70, more preferably 5:95 to 25:75, most preferably 7:93 to 20:80. Too small an amount of the modified polyester below 5% by weight is disadvantageous because the anti-hot offset properties are deteriorated and because it is difficult to attain both heat resistive preservability and low temperature fixation properties simultaneously.

It is preferred that the non-modified polyester be compatible with the modified polyester for reasons of low fixation properties and anti-hot offset properties of the toner. Thus, the monomer units (polyol unit and polyacid unit) constituting the non-modified polyester preferably have structures similar to those of the modified polyester.

The toner binder generally has a hydroxyl value of at least 5, preferably 10–120, more preferably 20–80. Too low a hydroxyl value of less than 5 is disadvantageous to simultaneously attain both good heat resistive preservability and low temperature fixation properties of the toner. The toner binder generally has an acid value of 1–30, preferably 5–20 mg KOH for reasons of improved compatibility between the toner and paper and improved fixing efficiency.

The toner binder used in the present invention generally has a glass transition point of 40–70° C., preferably 50–65° C. A glass transition point of less than 40° C. tends to cause deterioration of heat resistive preservability, while too high a glass transition point of over 70° C. tends to cause deterioration of low temperature fixation properties. Because of the presence of the modified polyester, the dry toner of the present invention exhibits superior heat resistance and preservability even thought the glass transition point of the toner is low.

The present invention further provides a dry toner for developing an electrostatic image which has a melt viscosity at 110° C. of $2.0\times10^3$ to $2.0\times10^4$ Pa·s and a melt viscosity at 130° C. of $2.0\times10^3$ or less and which provides such a fixed image on an overhead projector sheet that has a deposition amount of 0.8–1.2 mg/cm$^2$ and has a contact angle to water of 90°–130°. The dry toner having the above melt viscosity properties and contact angle to water exhibits good image transferability, good heat resistance, good low-temperature fixation efficiency and good anti-hot offset properties.

The melt viscosity as used herein is as measured with a flow tester. When the melt viscosity is within the above range, the toner can exhibit suitable fixation efficiency.

The contact angle to water serves as an index for evaluating anti-hot offset properties of a toner containing a releasing agent. The hot offset is a problem that a toner during fixation is adhered to a surface of a hot roller. When the contact angle to water is within the above range, the releasing agent can exhibit its full effect so that hot offset can be effectively prevented. When the contact angle to water is less than 90°, the releasing agent fails to exude from the toner during fixation so that anti-hot offset is not effectively improved. When the contact angle to water is greater than 130°, the binder resin is not effectively melted so that the fixation efficiency of the toner image is not effectively improved.

The toner of the present invention preferably contains a releasing agent in addition to the toner binder and the colorant. The releasing agent preferably has a melting point of 40–160° C., preferably 50–120° C., more preferably 60–110° C. A melting point of the releasing agent below 40° C. may adversely affect the heat resistance and preservability of the toner, while too high a melting point in excess of 160° C. is apt to cause cold offset of toner when the fixation is performed at a low temperature.

The releasing agent is preferably a wax. Any wax may be suitably used for the purpose of the present invention. Examples of such waxes include vegetable waxes such as candelilla wax, carnauba wax, Japan wax and rice wax; animal waxes such as lanolin and bees wax; mineral waxes such as montan wax; petroleum waxes such as paraffin wax and microcrystalline wax; long chain hydrocarbon waxes such as polyethylene wax, sazole wax and polypropylene wax; acid amides; synthetic ester waxes.

Vegetable waxes such as candelilla wax, carnauba wax and rice wax are preferably used for reasons of good dispersibility in a polyester resin and good behavior during melting of the polyester resin.

The carbonyl group-containing wax is also preferably used for the purpose of the present invention. Illustrative of suitable carbonyl group-containing waxes are polyalkanoic acid ester waxes such as carnauba wax, montan wax, trimethylolpropane tribehenate, pentaerythritol tetrabehenate, pentaerythritol diacetate dibehenate, glycerin tribehenate and 1,18-octadecanediol distearate; polyalkanol ester waxes such as tristearyl trimellitate and distearyl maleate; polyalkanoic acid amide waxes such as ethylenediamine dibehenyl amide; polyalkylamide waxes such as trimellitic acid tristearyl amide; and dialkyl ketone waxes such as distearyl ketone. Above all, the use of a polyalkanoic acid ester wax is preferred.

It is preferred that the releasing agent have such a particle size distribution that that portion of the releasing agent which has a dispersion diameter of 0.1–3 $\mu$m, more preferably 1–2 $\mu$m, accounts for at least 70% of a total number thereof for reasons of well balanced image quality (including image reproducibility) and anti-hot offset while ensuring good transparency and good gloss of images.

It has been found that the wax particles having suitable particle diameters can be dispersed in a modified ester-containing binder resin in a stable manner. Toner has been generally prepared by pulverization of coarse particles. In this case, because of low melt viscosity of a polyester resin, it is difficult to apply suitable shearing forces thereto during kneading or milling. Hence, it is difficult to control the particle size of the wax particles. On the other hand, the use of a modified polyester resin permits the preparation of toner by a dispersion method. In this case, non polar wax particles can be stably dispersed in the polyester, probably because the polar regions of the modified polyester accelerate negative adsorption in the interface between the wax and the polar regions. Since, in the toner thus obtained, a major part of the wax particles are buried in the resin matrix, the wax might not effectively exhibit its hot offset properties. However, by using wax having a suitable melting point, effective anti-hot offsetting properties can be obtained, as described above.

It is also preferred that the releasing agent be a vegetable wax having a weight average molecular weight of 400–5,000 for reasons of storage stability of the toner and prevention of deposition thereof to surfaces of the carrier and/or photoconductor. The weight average molecular weight is as measured by gel permeation chromatography. The releasing agent preferably has an acid value of 1–20 for reasons of good efficiency of fixation of toner images on an image receiving member such as paper.

The amount of the wax in the toner is generally 1–40% by weight for reasons of obtaining satisfactory anti-hot offset properties. Since a large amount of the wax will result in an increase of the amount thereof exposed on the surfaces of the toner particles and in reduction of fluidity of the toner particles, the amount of the wax used is preferably 1–20% by weight, more preferably 1–10% by weight, based on the weight of the toner.

Preferably, the wax has a melt viscosity of 5–1000 cps, more preferably 10–100 cps, at a temperature higher by 20° C. than the melting point thereof. When the viscosity is greater than 1000 cps, the anti-hot offset properties and low fixation properties of the toner are adversely affected.

As the colorant usable for the electrostatic image developing toner of the present invention, any colorant known to be used conventionally for the preparation of a toner can be employed. Suitable colorants for use in the toner of the present invention include known pigments and dyes. These pigments and dyes can be used alone or in combination.

Specific examples of such dyes and pigments include carbon black, Nigrosine dyes, iron black, Naphthol Yellow S, Hansa Yellow (10G, 5G and G), cadmium yellow, yellow colored iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow NCG)-, Vulcan Fast Yellow (5G and R), Tartrazine Yellow Lake, Quinoline Yellow Lake, Anthracene Yellow BGL, isoindolinone yellow, red iron oxide, red lead, orange lead, cadmium red, cadmium mercury red, antimony orange, Permanet Red 4R, Para Red, Fire Red, p-chloro-o-nitro aniline red, Lithol Fast Scarlet G, Brilliant Fast Scarlet, Brilliant Carmine BS, Permanent Red (F2R, F4R, FRL, FRLL and F4RH), Fast Scarlet VD, Vulkan Fast Rubine B, Brilliant Scarlet G, Lithol Rubine GX Permanent F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosine Lake, Rhodamine Lake B, Rhodamine Lake Y, Alizarine Lake, Thioindigo red B, Thioindigo Maroon, Oil Red, quinacridone red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue lake, metal-free Phthalocyanine Blue, Phthalocyanine Blue, Fast Sky Blue, Indanthrene Blue (RS, BC), indigo, ultramarine, prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, and the like. These dyes and pigments are employed alone or in combination. The content of a coloring agent in the toner of the present invention is preferably from about 1–15% by weight, more preferably 3–10% by weight, based on the weight of the toner.

In one embodiment of the production of toner, the colorant is composited with a resin binder to form a master batch.

As the binder resin for forming the master batch, the above-described modified polyester, non-modified polyester may be used. Further, various other polymers may also be used for the formation of the master batch. Specific examples of such other polymers for use in the formation of the master batch include homopolymers of styrene or substituted styrenes such as polystyrene, polychlorostyrene, and polyvinyltoluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl $\alpha$-chloromethacrylate copolymer, styrene-acrylonitrile copolymer, styrene-vinylethyl ether copolymer, styrene-vinylmethylketone copolymer, styrene-butadiene copolymer, styrene-isoprene copolymer, styrene-acrylonitrile-indene copolymer, styrene-maleic acid copolymer, and styrene-maleic acid ester copolymer; and polymethyl methacrylate, polybutyl methacrylate, polyvinyl chloride, polyvinyl acetate, polyethylene, polypropylene, polyester, polyvinylbutyl butyral, polyacrylic resin, rosin, modified rosin, terpene resin, phenolic resin, aliphatic hydrocarbon resin, alicyclic hydrocarbon resin, aromatic petroleum resin, chlorinated paraffin, and paraffin wax. These polymers can be used alone or in combination.

The master batch may be obtained by mixing and kneading the binder resin and the colorant while applying a large shear strength thereto using a suitable kneader such as a three-roller mill. In this case, an organic solvent may be used to enhance the interaction between the resin and the colorant. If desired, "flushing" method may be adopted to obtain the master batch. In this method, an aqueous paste containing a colorant is mixed and kneaded together with a binder resin and an organic solvent so that the colorant migrates to the organic phase. The organic solvent and water are then removed.

The toner of the present invention may contain a charge controlling agent, if desired. Any charge controlling agent generally used in the field of toners for use in electrophotography may be used for the purpose of the present invention. Examples of such charge controlling agents include a nigrosine dye, a triphenylmethane dye, a chromium-containing metal complex dye, a molybdic acid chelate pigment, a rhodamine dye, an alkoxyamine, a quaternary ammonium salt including a fluorine-modified quaternary ammonium salt, alkylamide, phosphorus and a phosphorus-containing compound, tungsten and a tungsten-containing compound, a fluorine-containing activator material, and metallic salts of salicylic acid and derivatives thereof.

Specific examples of the charge controlling agents include Bontron 03 (Nigrosine dyes), Bontron P-51 (Quaternary ammonium salts), Bontron S-34 (metal-containing azo dyes), E-82 (oxynaphthoic acid type metal complex), E-84 (salicylic acid type metal complex) and E-89 (phenol type condensation products), which are manufactured by Orient Chemical Industries Co., Ltd.; TP-302 and TP-415 (quaternary ammonium salts molybdenum complex), which are manufactured by Hodogaya Chemical Co., Ltd.; Copy Charge PSY VP2038 (quaternary ammonium salts)' Copy Blue PR (triphenylmethane derivatives), Copy Charge NEG VP2036 (quaternary ammonium salts) and Copy Charge NX VP434(quaternary ammonium salts), which are manufactured by Hoechst AG; LRA-901 and LR-147 (boron complex), which are manufactured by Japan Carlit Co.; copper Phthalocyanine; perylene; quinacridone; azo type pigments; and polymer compounds having a functional group such as a sulfonic acid group, a carboxyl group or a quaternary ammonium salt group.

The amount of charge control agent for use in the color toner may be determined in light of the kind of binder resin to be employed, the presence or absence of additives, and the preparation method of the toner including the method of dispersing the composition of the toner. It is preferable that the amount of charge control agent be in the range of 0.1 to 10 parts by weight, and more preferably in the range of 0.2 to 5 parts by weight, per 100 parts by weight of the binder resin. By the addition of the charge control agent in such an amount, sufficient chargeability for use in practice can be imparted to the toner. Further, electrostatic attraction of the toner to a developing roller can be prevented, so that the decrease of fluidity of the developer and the decrease of image density can be prevented.

The charge controlling agent and wax may be mixed and kneaded with the binder resin or the above master batch.

Inorganic fine particles may be suitably used, as an external additive, to improve the fluidity, developing efficiency and chargeability of the toner by being attached to outer surfaces of the toner particles. Such inorganic fine particles include silica, alumina, titanium oxide, barium titanate, magnesium titanate, calcium titanate, strontium titanate, zinc oxide, quartz sand, clay, mica, wallstonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride. These inorganic fine particles preferably have a primary particle diameter of 5 mμ (5 nm) to 2 μm, more preferably 5 mμ to 500 mμ, and a BET specific surface area of 20–500 $m^2/g$. The inorganic fine particles are used in an amount of generally 0.01–5% by weight, preferably 0.01–2% by weight, based on the weight of the toner.

The external additive (fluidizing agent) may also be fine particles of a polymeric substance such as polystyrene, polymethacrylate or an acrylate copolymer obtained by soap-free emulsion polymerization, suspension polymerization or dispersion polymerization; silicone, benzoguanamine or nylon obtained by polycondensation; or a thermosetting resin.

By subjecting these fluidizing agents to a surface treatment to improve the hydrophobic properties thereof, deterioration of the fluidity and the charge properties of the toner can be avoided even under high humidity conditions. Suitable surface treating agents include silane coupling agents, silane coupling agents having a fluorinated alkyl group, organic titanate type coupling agents, aluminum type coupling agents, silicone oil and modified silicone oil.

Cleaning property improving agents may be also used in the toner of the present invention for facilitating the removal of toner remaining on a photoconductor or an intermediate transfer medium after the transference. Examples of such cleaning property improving agents include fatty acids and their metal salts such as stearic acid, zinc stearate and calcium stearate, and particulate polymers such as polymethyl methacrylate particles and polystyrene particles which are manufactured, for example, by the soap-free emulsion polymerization method. The particulate polymer preferably has a volume average particle diameter of 0.01–1 μm.

Dry toner according to the present invention may be prepared as follows.

First, ingredients of the toner such as a binder including a modified polyester resin, a coloring agent, wax and a charge controlling agent are mechanically mixed with each other using a mixer such as a rotary blade mixer to obtain a mixture.

The mixture is then kneaded using a suitable kneader. A single axis type (or single cylinder type) kneader, a two axis type (or two cylinder type) continuous extruder or a roll mill may be suitably used as the kneader. The kneading should be performed at a temperature near the softening point of the binder resin so as not to cause breakage of the molecular chain of the binder resin. Too high a temperature above the softening point will cause breakage of the molecular chain of the binder resin. The dispersion of the coloring agent, etc. in the binder resin will not sufficiently proceed when the temperature is excessively lower than the softening point.

The kneaded mixture is then solidified and the solidified mixture is grounded, preferably in two, coarsely grinding and succeeding finely grinding stages. The earlier stage may be carried out by impinging the solidified mixture to an impact plate under a jet stream, while the later stage may be performed using a combination of a rotor and a stator with a small gap. The ground mixture is classified in a jet flow utilizing tangential force to obtain a toner having an average size of, for example, 5–20 μm.

The thus obtained toner is, if desired, mixed with an external additive such as a fluidizing agent to improve the fluidity, preservability, developing efficiency and transfer efficiency. The mixing with the external additive may be carried out using a conventional mixer preferably capable of controlling the mixing temperature. The external additive may be added gradually or at once. The rotational speed, mixing time and mixing temperature may be varied in any suitable manner. Illustrative of suitable mixers are V-type mixers, rocking mixers, Ledige mixers, nauter mixers and Henschel mixers.

As methods to obtain spherical toner, there may be mentioned a mechanical method in which ingredients of the toner such as a binder and a colorant are melt-kneaded, solidified, ground and further processed with a hybridizer or a mechanofusion; a spray dry method in which ingredients of the toner are dispersed in a solution of a toner binder dissolved in a solvent, the dispersion being subsequently spray dried; and a dispersion method in which an organic solvent solution or dispersion containing ingredients of the toner such as a binder resin and wax is dispersed in an aqueous medium with stirring, preferably while applying shear forces to the wax, to form toner particles which are subsequently separated and dried.

When the dispersion method is adopted, the polar portions of the modified polyester which are compatible with the aqueous medium selectively gather on surfaces of the toner, so that the wax particles are prevented from exposing on the surfaces of the toner. In the thus obtained toner, the wax particles have are finely divided and dispersed in a inside region of the toner, so that toner filming can be prevented and the toner occur can be charged in a stable manner.

The aqueous medium used in the dispersion method may be water by itself or a mixture of water with a water-miscible solvent such as an alcohol, e.g. methanol, isopropanol or ethylene glycol; dimethylformamide; tetrahydrofuran; cellosolve, e.g. methyl cellosolve; or a lower ketone, e.g. acetone or methyl ethyl ketone.

The modified polyester used in the dispersion method may be a prepolymer thereof. The prepolymer may be converted into the modified polyester during the dispersing step in the aqueous medium by reaction with, for example, a chain extender or a crosslinking agent. For example, a urea-modified polyester may be produced during the dispersing step in the aqueous medium by reaction of an isocyanate-containing polyester prepolymer with an amine. The reaction may be performed at a temperature of 0–150° C. (under a pressurized condition), preferably 40–98° C., for 10 minutes to 40 hours, preferably 2–24 hours in the presence of, if desired, a catalyst such as dibutyltin laurate or dioctyltin laurate.

It is preferred that other ingredients, such as a colorant, a colorant master batch, a wax, a charge controlling agent and a non-modified polyester, than the modified polyester be previously mixed with the modified polyester (or a prepolymer thereof) in an organic solvent. However, at least one of such ingredients may be added to the aqueous medium at the time of dispersing the organic solvent solution of the modified polyester (or a prepolymer thereof) into the aqueous medium or after the formation of toner particles dispersed in the aqueous medium, if desired. For example, the colorant may be incorporated into the toner after the toner particles containing the wax, the binder, etc.

In one preferred embodiment, the wax is dispersed in the organic solvent solution containing the modified polyester (or a prepolymer thereof) by stirring the wax and the modified polyester in an organic solvent in a stirring tank. The resulting mixture is then ground with an atriter, a ball mill, a sand mill or a vibration mill using a granular medium such as granules of stainless steel, carbon steel, alumina, zirconia or silica. In this case, the colorant may be suitably dispersed together with the wax. Thus, the colorant is disaggregated in the stirring tank and dispersed in the mill into an average particle diameter of 0.7 μm or less, preferably 0.4 μm or less. A color toner obtained by the above method gives images of excellent gloss and transparency with good reproducibility.

As the organic solvents, there may be mentioned aromatic hydrocarbons such as toluene, xylene and benzene; halogenated hydrocarbons such as carbon tetrachloride, methylene chloride, 1,2-dichloroethane, 1,1,2-trichloroethane, trichloroethylene, chloroform, monochlorobenzene and dichlorloethylidene; esters such as methyl acetate and ethyl acetate; and ketones such as methyl ethyl ketone and methyl isobutyl ketone. These solvents may be used singly or in combination. The amount of the organic solvent is generally 5–300 parts by weight, preferably 10–100 parts by weight, more preferably 25–70 parts by weight, per 100 parts by weight of the modified polyester (or a prepolymer thereof). The use of the solvent can produce toner particles having a narrow particle size distribution.

Dispersion into the aqueous phase may be carried out using any desired dispersing device, such as a low speed shearing type dispersing device, a high speed shearing type dispersing device, an abrasion type dispersing device, a high pressure jet type dispersing device or an ultrasonic-type dispersing device. A high speed shearing type dispersing device is preferably used for reasons of obtaining dispersed toner particles having a diameter of 2–20 μm in a facilitated manner. The high speed shearing type dispersing device is generally operated at a revolution speed of 1,000–30,000 rpm, preferably 5,000–20,000 rpm. The dispersing time is generally 0.1 to 5 minutes in the case of a batch type dispersing device. The dispersing step is generally performed at 0–150° C. (under a pressurized condition), preferably 40–98° C. A higher temperature is suitably used to decrease the viscosity of the mass.

The aqueous medium is generally used in an amount of 50–2,000 parts by weight, preferably 100–1,000 parts by weight per 100 parts by weight of the toner composition containing the modified polyester (or a prepolymer thereof) and other ingredients for reasons of obtaining suitable dispersion state.

A dispersing agent may be used in dispersing the toner composition into the aqueous medium to stabilize the dispersion and to obtain sharp particle size distribution. Examples of the dispersing agent include anionic surface active agents such as a salt of alkylbenzensulfonic acid, a salt of α-olefinsulfonic acid and a phosphoric ester; cationic surface active agents such as amine surfactants (e.g. an alkylamine salt, an aminoalcohol fatty acid derivative, a polyamine fatty acid derivative and imidazoline), and quaternary ammonium salt surfactants (alkyl trimethylammonium salt, dialkyl dimethylammonium salt, alkyl dimethylammonium salt, pyridium salt, alkyl isoquinolinium salt and benzethonium chloride; nonthe modified polyester (or a prepolymer thereof) the modified polyester (or a prepolymer thereof); nonionic surface active agent such as a fatty amide derivative and polyhydric alcohol derivative; and ampholytic surface active agents such as alanine, dodecyl di(aminoethyl)glycine and di(octylaminoethyl)glycine and N-alkyl-N,N-dimethylammoniumbetaine.

A surfactant having a fluoroalkyl group can exert its effects in an only very small amount and is preferably used.

Suitable anionic surfactants having a fluoroalkyl group include fluoroalkylcarboxylic acids having from 2–10 carbon atoms and their metal salts, perfluorooctanesulfonylglutamic acid disodium salt, 3-[omega-fluoroalkyl($C_6$–$C_{11}$)oxy]-1-alkyl ($C_3$–$C_4$) sulfonic acid sodium salts, 3-[omega-fluoroalkanoyl($C_6$–$C_8$)-N-ethylamino]-1-propanesulfonic acid sodium salts, fluoroalkyl($C_{11}$–$C_{20}$)carboxylic acids and their metal salts, perfluoroalkylcarboxylic acids ($C_7$–$C_{13}$) and their metal salts, perfluoroalkyl($C_4$–$C_{12}$)sulfonic acid and their metal salts, perfluorooctanesulfonic acid diethanolamide, N-propyl-N-(2-hydroxyethyl) perfluorooctanesulfonamide, perfluoroalkyl($C_6$–$C_{10}$) sulfoneamidopropyl trimethylammonium salts, perfluoroalkyl ($C_6$–$C_{10}$)-N-ethylsulfonylglycine salts, and monoperfluoroalkyl($C_6$–$C_{16}$)ethylphosphoric acid esters.

Examples of tradenames of anionic surfactants having a perfluoroalkyl group include Surflon S-111, S-112 and S-113 (manufactured by Asahi Glass Co., Ltd.), Florard FC-93, Ec95, FC-98 and FC-129 (manufactured by Sumitomo 3M Ltd.), Unidine DS-101 and DS-102 (manufactured by Daikin Co., Ltd.), Megafac F-110, F-120, F-113, F-191, F-812 and F-833 (manufactured by Dainippon Ink and Chemicals, Inc.), Ektop EF-102, 103, 104, 105, 112, 123A, 123B, 306A, 501, 201 and 204 (manufactured by Tochem Products Co., Ltd.), and Phthargent F-100 and F-150 (manufactured by Neos co., Ltd.).

Examples of suitable cationic surfactants having a fluoroalkyl group include primary, secondary or tertiary aliphatic amine salts; aliphatic quaternary ammonium salts such as perfluoroalkyl($C_6$–$C_{10}$) sulfonamidopropyltrimethyl-ammonium salts; benzalkonium salts; benzethonium chloride; pyridinium salts; and imidazolinium salts. Tradenamed cationic surfactants include Surflon S-121 (Asahi Glass Co., Ltd.), Florard FC-135 (manufactured by Sumitomo 3M Ltd.), Unidine DS-202 (manufactured by Daikin Co.), Megafac F-150 and F-824 (Dainippon Ink and Chemicals Inc.), Ektop EF-132 (manufactured by Tochem Products Co., Ltd.), and Phthargent F-300 (manufactured by Neos Co., Ltd.).

In addition, dispersants of inorganic compounds, which are hardly soluble in water, such as tricalcium phosphate, calcium carbonate, titanium oxide, colloidal silica, and hydroxyapatite can also be employed.

In addition, primary particles can be stabilized with polymer type protective colloids. Specific examples of such polymer type protective colloids include homopolymers and copolymers of the following compounds: acids such as acrylic acid, methacrylic acid, α-cyanoacrylic acid, α-cyanomethacrylic acid, itaconic acid, crotonic acid, fumaric acid, maleic acid, and maleic anhydride; (meth) acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylol acrylamide, and N-methylol methacrylamide; vinyl alcohol, ethers such as vinyl methyl ether, vinyl ethyl ether and vinyl propyl ether; esters of vinyl alcohol with a carboxylic acid such as vinylacetate, vinylpropionate and vinyl butyrate; amides such as acrylamide, methacrylamide, diacetoneacrylamide, and their methylol compounds; acid chloride compounds such as acrylic acid chloride, and methacrylic acid chloride; homopolymers and copolymers of compounds having a nitrogen atom or a heterocyclic ring including a nitrogen atom such as vinyl pyridine, vinyl pyrrolidone, vinyl imidazole and ethylene imine; polyoxyethylene compounds such as polyoxyethylene, polyoxypropylene, polyoxyethylenealkylamine, polyoxypropylenealkylamine, polyoxyethylenealkylamide, polyoxypropylenealkylamide, polyoxyethylenenonylphenylether, polyoxyethylenelaurylphenylether, polyoxyethylenestearylphenylether, and polyoxyethylenenonylphenylether; and cellulose compounds such as methyl cellulose, hydroxyethyl cellulose, and hydroxypropyl cellulose.

The resulting dispersion or emulsion of toner particles in the aqueous medium is then treated to remove the organic solvent. The removal of the organic solvent can be carried out by gradually heating the dispersion to evaporate the organic solvent and also water to dryness. Alternatively, the dispersion is sprayed into a dry atmosphere to evaporate the organic solvent to obtain fine toner particles which are then dried to remove water. The dry atmosphere may be a gas, such as air, nitrogen, carbon dioxide, combustion gas, which is heated above the boiling point of the organic solvent used. A spray drier, a belt drier or a rotary kiln may be used for separating and drying the toner particles.

When a dispersing agent capable of being dissolved in an acid or an alkali is used, washing with an acid or alkali and then with water can remove the dispersing agent from the toner particles. For example, calcium phosphate may be removed by washing with an acid and then with water. An enzyme may be also used to remove certain kinds of the dispersing agent. Although the dispersing agent can be retained on the toner particles, the removal thereof is preferable for reasons of charging characteristics of the toner.

When the toner particles in the dispersion obtained have a wide particle size distribution, classification may be conducted. The classification for the removal of excessively fine particles is preferably carried out before separation of the toner particles from the dispersion for reasons of efficiency, though the classification may be preceded by the separation and drying of the particles. Classification for the removal of fine particles may be performed using, for example, a cyclone, a decanter or a centrifugal device. Air classification may be suitably adopted for the removal of large particles after drying of the toner particles. Large and small particles thus separated may be reused as raw materials for the preparation of the toner.

The thus obtained toner particles can be mixed with different types of particles such as a particulate release agent, a particulate charge controlling agent, a particulate fluidizing agent and a particulate colorant. By applying mechanical force to the mixture, these different particles can be fixed and unified with the surface of the toner particles and thereby the different particles are prevented from releasing from the resultant complex particles. Methods useful for applying mechanical force include impacting the mixture rapidly-rotating blades; and discharging the mixture into a high speed airflow so that the particles of the mixture accelerate and collide with each other or the particles impact against a proper plate or some such object. Specific examples of such apparatuses include an Ong Mill (manufactured by Hosokawa Micron Co., Ltd.), modified I type Mill in which pressure of air for pulverization is reduced (manufactured by Nippon Pneumatic Co., Ltd.), Hybridization System (manufactured by Nara Machine Co., Ltd.), Kryptron System (manufactured by Kawasaki Heavy Industries, Ltd.), and automatic mortars.

The toner according to the present invention preferably has a volume average particle size of 3 to 10 μm for reasons of obtaining high grade images and good transferability and cleaning efficiency.

The toner according to the present invention can be used as a two-component developer after mixed with a carrier or as a one-component developer or microtoning developer having magnetic powders incorporated in the toner.

When the toner of the present invention is employed as a two-component developer, any conventionally-known carrier can be used. In this case, the toner is generally used in an amount of 1–10 parts by weight per 100 parts by weight of the carrier. Examples include magnetic powders such as iron powders, ferrite powders, magnetite powders, magnetic resin powders and nickel powders and glass beads, and these powders having a surface treated with a resin. The magnetic toner generally has a particle diameter of 20–200 μm. Examples of the resin for covering the surface of the carrier include amino resins, urea-formaldehyde resins, melamine resins, benzoguanamine resins, urea resins, polyamide resins and epoxy resins. Also usable for covering carrier are polyvinyl or polyvinylidene resins; polystyrene-type resins such as acrylic resins, polymethyl methacrylate resins, polyacrylonitrile resins, polyvinyl acetate resins, polyvinyl fluoride resins; polyvinyl butyral resins, polyvinyl alcohol resins, polystyrene resins and styrene-acrylic acid copolymers; halogenated olefin resins such as polyvinyl chloride resins; polyester resins such as polyethylene terephthalate resins and polybutylene terephthalate resins; polycarbonate resins; polyethylene resins; polyvinylidene fluoride resins; polytrifluoroethylene resins; polyhesafluoropropylene resins; copolymers of vinylidene fluoride and acrylic monomer; copolymers of vinylidene fluoride and vinyl fluoride; terpolymers of tetrafluoroethylene, vinylidene fluoride and a fluorine-free monomer; and silicone resins.

The resin coating for the carrier may contain conductive powder such as metal powder, carbon black, titanium oxide, tin oxide or zinc oxide. The conductive powder preferably has an average particle diameter of 1 μm or less for reasons of easy control of the electric resistance.

The toner of the present invention may be used as a one-component magnetic or nonmagnetic toner requiring no carrier.

The following examples will further describe the present invention but are not intended to limit the present invention. Parts are by weight.

EXAMPLE 1

Synthesis of Toner Binder

In a reactor equipped with a condenser, a stirrer and a nitrogen feed pipe, 724 parts of an ethylene oxide (2 mol) adduct of bisphenol A, 276 parts of isophthalic acid and 2 parts of dibutyltin oxide were charged. The mixture was reacted at 230° C. under ambient pressure for 8 hours. The reaction was further continued for 5 hours at a reduced pressure of 10–15 mmHg. The contents in the reactor was then cooled to 160° C., to which 32 parts of phthalic anhydride were added. The resulting mixture was reacted for 2 hours. The polyester-containing mixture thus obtained was cooled to 80° C. and was reacted with 188 parts of isophorone diisocyanate for 2 hours to obtain an isocyanate-containing polyester prepolymer (prepolymer (1)).

The prepolymer (1) (267 parts) was then reacted with isophoronediamine (14 parts) at 50° C. for 2 hours to obtain a urea-modified polyester (urea-modified polyester (1)) having a weight average molecular weight of 64,000.

In the same manner as described above, an ethylene oxide (2 mol) adduct of bisphenol A (724 parts) was reacted with isophthalic acid (276 parts) at 230° C. under ambient pressure for 8 hours. The reaction was further continued for 5 hours at a reduced pressure of 10–15 mmHg to obtain a non-modified polyester (Non-Modified Polyester (a)) having such a molecular weight distribution according to gel permeation chromatography as to provide a main peak at a molecular weight of 5,000.

The above urea-modified polyester (1) (100 parts) and 900 parts of the Non-Modified Polyester (a) were dissolved in 2000 parts of a 1:1 (by weight) mixed solvent of ethyl acetate and methyl ethyl ketone. A part of the solution was then dried in vacuo to obtain a toner binder (toner binder (1))

Preparation of Toner

240 Parts of the ethyl acetate/MEK solution of the toner binder (1), 5 parts of carnauba wax (molecular weight; 2000, acid value; 3, melting point: 84° C.), 4 parts of a copper phthalocyanine blue pigment were charged in a beaker and stirred at 60° C. at 12000 rpm using a TK-type homomixer to dissolve and disperse the mixture uniformly, thereby obtaining a toner composition solution. 706 parts of ion-exchanged water, 294 parts of a 10% hydroxyapatite suspension (Supertite 10, made by Nippon Chemical Industrial Co., Ltd.) and 0.2 parts of sodium dodecylbenzenesulphonate were charged in a beaker and uniformly dissolved. The solution was heated to 60° C. The toner composition solution was added to the solution with stirring at 12000 rpm with a TK-type homomixer and the stirring was continued for another ten minutes. The mixture was poured into a flask equipped with a poker and a thermometer, and heated to 98° C. to remove the solvent, followed by filtering, washing and drying. The thus obtained particles were air-classified, thereby obtaining toner particles having a volume-average particle size of 6 μm, a Dv/Dp ratio of 1.10 and a sphericity of 0.98. 100 Parts of the toner particles, 0.5 parts of hydrophobic silica and 0.5 parts of hydrophobized titanium oxide were mixed in a Henschel mixer to obtain toner (1) of the present invention. The toner binder of the Toner (1) had a main peak molecular weight MP of 5000, a content of a component having an Mw of at least 30000 of 5%, an Mw/Mn ratio of 3, a Tg of 62° C. and an acid value of 10. FIG. 1 shows a GPC chromatograph of the binder in the toner. The physical properties and the results of the evaluations of the toner are summarized in Tables 1-1 through 1-4 and Tables 2-1 and 2-2.

EXAMPLE 2

Synthesis of Toner Binder

334 Parts 2 mol ethylene oxide adduct of bisphenol A, 334 Parts 2 mol propylene oxide adduct of bisphenol A, 274 parts of isophthalic acid and 20 parts of trimelltic anhydride were polycondensed and then reacted with 154 parts of isophorone diisocyanate as in the case of Example 1 to obtain an isocyanate group-containing prepolymer (2). 213 Parts of the prepolymer (2), 9.5 parts of isophrone diamine and 0.5 parts of dibutyl amine were reacted in the same manner as in Example 1, thereby obtaining a urea-modified polyester (2) having a weight-average molecular weight of 79000. 200 Parts of the urea-modified polyester (2) and 800 parts of the unmodified polyester (a) were dissolved and mixed in 2000 parts of a mixed solvent of ethyl acetate/MEK (1/1) to obtain an ethyl acetate/MEK solution of a toner binder (2). A part of the solution was dried under a reduced pressure to isolate the toner binder (2).

Preparation of Toner

A toner (2) of the present invention was prepared in the same manner as in Example 1 except that the dissolution temperature and the dispersion temperature were changed to 50° C. The toner binder of the toner had a main peak molecular weight Mp of 5000, a content of a component having an Mw of at least 30000 of 6%, an Mw/Mn ratio of 3.5, a Tg of 65° C., and an acid value of 10. The physical properties and the results of the evaluations of the toner are summarized in Tables 1-1 through 1-4 and Tables 2-1 and 2-2.

EXAMPLE 3

Preparation Example of Prepolymer

724 Parts 2 mol ethylene oxide adduct of bisphenol A, 250 parts of isophthalic acid, 24 parts of terephthalic acid and 2 parts of dibutyltin oxide were charged in a reaction vessel equipped with a reflux condenser, an stirrer and a nitrogen gas intake pipe and reacted at 230° C. under normal pressure for 8 hours. This was further reacted under a reduced pressure of 10 to 15 mmHg for 5 hours while dehydrating and cooled to 160° C. To the reaction product was added 32 parts of phthalic anhydride. The mixture was reacted for two hours and then cooled to 80° C. This was reacted with 188 parts of isophorone diisocyanate in ethyl acetate for 2 hours to obtain an isocyanate group-containing prepolymer (3).

Preparation Example of Ketimine Compound

30 Parts of isophorone diamine and 70 parts of methyl ethyl ketone were charged in a reaction vessel equipped with a poker and a thermometer and reacted at 50° C. for 5 hours to obtain a ketimine compound (1).

Preparation Example of Toner 8.5 Parts of the prepolymer (3), 90 parts of the unmodified polyester (a) and 100 parts of ethyl acetate were charged in a beaker and dissolved by stirring. To the solution were added 5 parts of a carnauba wax (molecular weight: 2000, acid value:3, melting point: 84° C.) and 4 parts of a copper phthalocyanine blue pigment. This was stirred at 60° C. at 12000 rpm with a TK-type homomixer to dissolve and disperse the mixture uniformly. Finally, 1.5 Parts of the ketimine compound (1) was added and dissolved therein. This was designated as a toner composition solution (1). 706 Parts of ion-exchanged water, 294 parts of a 10% hydroxyapatite suspension (Supertite 10, made by Nippon Chemical Industrial Co., Ltd.), and 0.2 parts of sodium dodecylbenzenesulphonate were charged in a beaker and uniformly dissolved. The solution was heated to 60° C. The toner composition solution (1) was added to the solution with stirring at 12000 rpm with a TK-type homomixer and the stirring was continued for another ten minutes. The mixture was poured into a flask equipped with a poker and a thermometer and heated to 98° C. to cause a urea-forming reaction and remove the solvent, followed by filtering, washing and drying. The thus obtained particles were air-classified, thereby obtaining toner particles having a volume-average particle size of 6 $\mu$m, a Dv/Dp ratio of 1.12 and a sphericity of 0.98. 100 Parts of the toner particles, 0.5 parts of hydrophobic silica and 0.5 parts of hydrophobized titanium oxide were mixed in a Henschel mixer to obtain a toner (3) of the present invention. The toner binder of the toner (3) had a main peak molecular weight Mp of 5000, a content of a component having an Mw of at least 30000 of 5%, and an Mw/Mn ratio of 3. The physical properties and the results of the evaluations of the toner are summarized in Tables 1-1 through 1-4 and Tables 2-1 and 2-2.

EXAMPLE 4

Preparation of Toner

A toner (4) was obtained in the same manner as in Example 3 except that the amount of the prepolymer (3) was changed to 2.55 parts, the amount of the unmodified polyester (a) was changed to 97 parts and the amount of the ketimine compound (1) was changed to 0.45 parts. The toner binder of the toner (4) had a main peak molecular weight Mp of 5000, a content of a component having an Mw of at least 30000 of 3%, and an Mw/Mn ratio of 2. The physical properties and the results of the evaluations of the toner are summarized in Tables 1-1 through 1-4 and Tables 2-1 and 2-2.

EXAMPLE 5

Preparation of Toner

A toner (5) was obtained in the same manner as in Example 3 except that the amount of the prepolymer (3) was changed to 42.5 parts, the amount of the unmodified polyester (a) was changed to 50 parts and the amount of the ketimine compound (1) was changed to 7.5 parts. The toner binder of the toner (5) had a main peak molecular weight Mp of 5000, a content of a component having an Mw of at least 30000 of 8%, and an Mw/Mn ratio of 3.5. The physical properties and the results of the evaluations of the toner are summarized in Tables 1-1 through 1-4 and Tables 2-1 and 2-2.

EXAMPLE 6

Preparation of Toner

A toner (6) was obtained in the same manner as in Example 3 except that the amount of the prepolymer (3) was changed to 63.8 parts, the amount of the unmodified polyester (a) was changed to 25 parts and the amount of the ketimine compound (1) was changed to 11.2 parts. The toner binder of the toner (6) had a main peak molecular weight Mp of 5000, a content of a component having an Mw of at least 30000 of 9%, and an Mw/Mn ratio of 4.5. The physical properties and the results of the evaluations of the toner are summarized in Tables 1-1 through 1-4 and Tables 2-1 and 2-2.

EXAMPLE 7

Preparation of Toner

A toner (7) was obtained in the same manner as in Example 3 except that the amount of the prepolymer (3) was changed to 72.3 parts, the amount of the unmodified polyester (a) was changed to 15 parts and the amount of the ketimine compound (1) was changed to 12.7 parts. The toner binder of the toner (6) had a main peak molecular weight Mp of 5000, a content of a component having an Mw of at least 30000 of 10%, and an Mw/Mn ratio of 5. The physical properties and the results of the evaluations of the toner are summarized in Tables 1-1 through 1-4 and Tables 2-1 and 2-2.

EXAMPLE 8

Synthesis of Unmodified Polyester 924 parts of 2 mol ethylene oxide adduct of bisphenol A and 276 parts of terephthalic acid were polycondensed at 230° C. under normal pressure for 8 hours and then reacted under a reduced pressure of 10 to 15 mmHg for 5 hours to obtain an unmodified polyester (b) having a peak molecular weight of 5000.

Preparation of Toner

A toner (8) was obtained in the same manner as in Example 3 except that the unmodified polyester (b) was used in place of the unmodified polyester (a). The toner binder of the toner (8) had a main peak molecular weight Mp of 5000, a content of a component having an Mw of at least 30000 of 5%, an Mw/Mn ratio of 3, and an acid value of 0.5. The physical properties and the results of the evaluations of the toner are summarized in Tables 1-1 through 1-4 and Tables 2-1 and 2-2.

EXAMPLE 9

Synthesis of Unmodified Polyester 824 parts of 2 mol ethylene oxide adduct of bisphenol A and 276 parts of terephthalic acid were polycondensed at 230° C. under normal pressure for 8 hours and then reacted under a reduced pressure of 10 to 15 mmHg for 5 hours to obtain an unmodified polyester (c) having a peak molecular weight of 5000.

Preparation of Toner

A toner (9) was obtained in the same manner as in Example 3 except that the unmodified polyester (c) was used in place of the unmodified polyester (a). The toner binder of the toner (9) had a main peak molecular weight Mp of 5000, a content of a component having an Mw of at least 30000 of 5%, an Mw/Mn ratio of 3, and an acid value of 2. The physical properties and the results of the evaluations of the toner are summarized in Tables 1-1 through 1-4 and Tables 2-1 and 2-2.

EXAMPLE 10

Synthesis of Unmodified Polyester 724 parts of 2 mol ethylene oxide adduct of bisphenol A and 276 parts of terephthalic acid were polycondensed at 230° C. under normal pressure for 8 hours. This was further reacted under a reduced pressure of 10 to 15 mmHg for 5 hours and cooled to 160° C. To the reaction product was added 32 parts of trimellitic anhydride. The mixture was reacted for 2 hours to obtain an unmodified polyester (d) having a peak molecular weight of 5000.

Preparation of Toner

A toner (10) was obtained in the same manner as in Example 3 except that the unmodified polyester (d) was used in place of the unmodified polyester (a). The toner binder of the toner (10) had a main peak molecular weight Mp of 5000, a content of a component having an Mw of at least 30000 of 5%, an Mw/Mn ratio of 3, and an acid value of 25. The physical properties and the results of the evaluations of the toner are summarized in Tables 1-1 through 1-4 and Tables 2-1 and 2-2.

EXAMPLE 11

Synthesis of Unmodified Polyester 724 parts of 2 mol ethylene oxide adduct of bisphenol A and 276 parts of terephthalic acid were polycondensed at 230° C. under normal pressure for 8 hours. This was further reacted under a reduced pressure of 10 to 15 mmHg for 5 hours and cooled to 160° C. To the reaction product was added 48 parts of trimellitic anhydride. The mixture was then reacted for 2 hours to obtain an unmodified polyester (e) having a peak molecular weight of 5000.

Preparation of Toner

A toner (11) was obtained in the same manner as in Example 3 except that the unmodified polyester (e) was used in place of the unmodified polyester (a). The toner binder of the toner (11) had a main peak molecular weight Mp of 5000, a content of a component having an Mw of at least 30000 of 5%, and an Mw/Mn ratio of 3. The physical properties and the results of the evaluations of the toner are summarized in Tables 1-1 through 1-4 and Tables 2-1 and 2-2.

EXAMPLE 12

Synthesis of Unmodified Polyester 724 parts of 2 mol ethylene oxide adduct of bisphenol A and 276 parts of terephthalic acid were polycondensed at 230° C. under normal pressure for 2 hours and then reacted under a reduced pressure of 10 to 15 mmHg for 5 hours to obtain an unmodified polyester (f) having a peak molecular weight of 1000.

Preparation of Toner

A toner (12) was obtained in the same manner as in Example 3 except that the unmodified polyester (f) was used in place of the unmodified polyester (a). The toner binder of the toner (12) had a main peak molecular weight Mp of 1000, a content of a component having an Mw of at least 30000 of 4%, an Mw/Mn ratio of 4.5, and a Tg of 45° C. The physical properties and the results of the evaluations of the toner are summarized in Tables 1-1 through 1-4 and Tables 2-1 and 2-2.

EXAMPLE 13

Synthesis of Unmodified Polyester 724 parts of 2 mol ethylene oxide adduct of bisphenol A and 276 parts of terephthalic acid were polycondensed at 230° C. under normal pressure for 4 hours and then reacted under a reduced pressure of 10 to 15 mmHg for 5 hours to obtain an unmodified polyester (g) having a peak molecular weight of 2000.

Preparation of Toner

A toner (13) was obtained in the same manner as in Example 3 except that the unmodified polyester (g) was used in place of the unmodified polyester (a). The toner binder of the toner (13) had a main peak molecular weight Mp of 2000, a content of a component having an Mw of at least 30000 of 5%, an Mw/Mn ratio of 4, and a Tg of 52° C. The physical properties and the results of the evaluations of the toner are summarized in Tables 1-1 through 1-4 and Tables 2-1 and 2-2.

EXAMPLE 14

Synthesis of Unmodified Polyester 724 parts of 2 mol ethylene oxide adduct of bisphenol A and 276 parts of terephthalic acid were polycondensed at 230° C. under normal pressure for 10 hours and then reacted under a reduced pressure of 10 to 15 mmHg for 5 hours to obtain an unmodified polyester (h) having a peak molecular weight of 30000.

Preparation of Toner

A toner (14) was obtained in the same manner as in Example 3 except that the unmodified polyester (h) was used in place of the unmodified polyester (a). The toner binder of the toner (14) had a main peak molecular weight Mp of 20000, a content of a component having an Mw of at least 30000 of 6%, an Mw/Mn ratio of 2.5, and a Tg of 69° C. The physical properties and the results of the evaluations of the toner are summarized in Tables 1-1 through 1-4 and Tables 2-1 and 2-2.

EXAMPLE 15

Synthesis of Unmodified Polyester 724 parts of 2 mol ethylene oxide adduct of bisphenol A and 276 parts of terephthalic acid were condensed at 230° C. under normal pressure for 12 hours and then reacted under a reduced pressure of 10 to 15 mmHg for 5 hours to obtain an unmodified polyester (i) having a peak molecular weight of 30000.

Preparation of Toner

A toner (15) was obtained in the same manner as in Example 3 except that the unmodified polyester (i) was used in place of the unmodified polyester (a). The toner binder of the toner (15) had a main peak molecular weight Mp of 30000, a content of a component having an Mw of at least 30000 of 7%, an Mw/Mn ratio of 2, and a Tg of 73° C. The physical properties and the results of the evaluations of the toner are summarized in Tables 1-1 through 1-4 and Tables 2-1 and 2-2.

EXAMPLE 16

Preparation of Toner

A toner (16) was obtained in the same manner as in Example 3 except that no carnauba wax was added. The toner binder of the toner (16) had a main peak molecular weight Mp of 5000, a content of a component having an Mw of at least 30000 of 5%, and an Mw/Mn ratio of 3. The physical properties and the results of the evaluations of the toner are summarized in Tables 1-1 through 1-4 and Tables 2-1 and 2-2.

EXAMPLE 17

Preparation of Toner

A toner (17) was obtained in the same manner as in Example 3 except that the amount of the carnauba wax was changed to 10 parts. The toner binder of the toner (17) had a main peak molecular weight Mp of 5000, a content of a component having an Mw of at least 30000 of 5%, and an Mw/Mn ratio of 3. The physical properties and the results of the evaluations of the toner are summarized in Tables 1-1 through 1-4 and Tables 2-1 and 2-2.

EXAMPLE 18

Preparation of Toner

A toner (18) was obtained in the same manner as in Example 3 except that the amount of the carnauba wax was changed to 30 parts. The toner binder of the toner (18) had a main peak molecular weight Mp of 5000, a content of a component having an Mw of at least 30000 of 5%, and an Mw/Mn ratio of 3. The physical properties and the results of the evaluations of the toner are summarized in Tables 1-1 through 1-4 and Tables 2-1 and 2-2.

EXAMPLE 19

Preparation of Toner

A toner (19) was obtained in the same manner as in Example 3 except that the amount of the carnauba wax was changed to 50 parts. The toner binder of the toner (19) had a main peak molecular weight Mp of 5000, a content of a component having an Mw of at least 30000 of 5%, and an Mw/Mn ratio of 3. The physical properties and the results of the evaluations of the toner are summarized in Tables 1-1 through 1-4 and Tables 2-1 and 2-2.

EXAMPLE 20

Preparation of Toner

A toner was made of 100 parts of the toner binder (1) and 8 parts of carbon black in the following manner. The ingredients were preparatorily mixed in a Henschel mixer and kneaded in a continuous kneader. The kneaded mixture was finely pulverized with a jet pulverizer and classified with an air classifier. The thus obtained particles were subjected to a sphering treatment in a Turbo mill (manufactured by Turbo Kogyo K. K.), thereby obtaining toner particles having a volume-average particle size of 6 μm, a Dv/Dp ratio of 1.15 and a sphericity of 0.96. 100 Parts of the toner particles, 0.5 parts of hydrophobic silica and 0.5 parts of hydrophobized titanium oxide were mixed in a Henschel mixer to obtain a toner (20). The toner binder of the toner (20) had a main peak molecular weight Mp of 5000, a content of a component having an Mw of at least 30000 of 5%, and an Mw/Mn ratio of 3. The physical properties and the results of the evaluations of the toner are summarized in Tables 1-1 through 1-4 and Tables 2-1 and 2-2.

EXAMPLE 21

Synthesis of Polystyrene Graft-Modified Polyester

724 Parts 2 mol ethylene oxide adduct of bisphenol A, 200 parts of isophthalic acid, 70 parts of fumaric acid and 2 parts of dibutyltin oxide were charged in a reaction vessel equipped with a reflux condenser, an stirrer and a nitrogen gas intake pipe and reacted at 230° C. under normal pressure for 8 hours. This was further reacted under a reduced pressure of 10 to 15 mmHg for 5 hours and cooled to 160° C. To the reaction mixture was added 32 parts of phthalic anhydride. The mixture was reacted for 2 hours and then cooled to 80° C. This was reacted with 200 parts of styrene, 1 part of benzoyl peroxide and 0.5 parts of dimethylaniline in ethyl acetate for 2 hours. From the reaction mixture, ethyl acetate was removed by distillation, thereby obtaining a polystyrene graft-modified polyester having a weight-average molecular weight of 92000.

Preparation of Toner

A toner (21) was obtained in the same manner as in Example 1 except that the polystyrene graft-modified polyester was used in place of the urea-modified polyester (1). The toner binder of the toner (21) had a main peak molecular weight Mp of 5000, a content of components having an Mw of not smaller than 30000 of 5%, an Mw/Mn ratio of 3 a Tg of 62° C. and an acid value of 10. The physical properties and the results of the evaluations of the toner are summarized in Tables 1-1 through 1-4 and Tables 2-1 and 2-2.

COMPARATIVE EXAMPLE 1

Synthesis of Toner Binder 354 parts of 2 mol ethylene oxide adduct of bisphenol A, 166 parts of isophthalic acid were polycondensed using 2 parts of dibutyltin oxide as a catalyst to obtain a comparative toner binder (x) having a weight-average molecular weight of 8000.

Preparation of Toner

100 Parts of the comparative toner binder (x), 200 parts of ethyl acetate solution and 4 parts of a copper phthalocyanine blue pigment were charged in a beaker and stirred at 50° C. at 12000 rpm with a Tk-type homomixer to dissolve and disperse the mixture uniformly, thereby obtaining a toner composition solution. Using the toner composition solution, a comparative toner (1) was obtained in the same manner as in Example 1. The toner binder of the comparative toner (1) had a main peak molecular weight of 5000, a content of a component having an Mw of at least 30000 of 0.3%, an Mw/Mn ratio of 2 and a Tg of 57° C. The physical properties and the results of the evaluations of the toner are summarized in Tables 1-1 through 1-4 and Tables 2-1 and 2-2.

COMPARATIVE EXAMPLE 2

Preparation of Toner Binder

343 Parts of 2 mol ethylene oxide adduct of bisphenol A, 166 parts of isophthalic acid and 2 parts of dibutyltin oxide were charged in a reaction vessel equipped with a reflux condenser, an stirrer and a nitrogen gas intake pipe and reacted at 230° C. under normal pressure for 8 hours. This was further reacted under a reduced pressure of 10 to 15 mmHg for 5 hours and cooled to 80° C. To the reaction product was added 14 parts of toluene diisocyanate. The mixture was reacted in toluene at 110° C. for 5 hours, followed by removing the solvent, Thereby obtaining a urethane-modified polyester having a wight-average molecular weight of 98000. 363 Parts of 2 mol ethylene oxide adduct of bisphenol A and 166 parts of isophthalic acid were polycondensed as in the same manner as in Example 1 to obtain an unmodified polyester having a peak molecular weight of 3800, a hydroxyl value of 25, and an acid value of 7. 350 Parts of the urethane-modified polyester and 650 parts of the unmodified polyester were dissolved and mixed in toluene. From the solution, the solvent was removed to obtain a comparative toner binder (y).

Preparation of Toner

A toner was made of 100 parts of the comparative toner binder (y) and 4 parts of a copper phthalocyanine blue pigment. The ingredients were preparatorily mixed in a Henschel mixer and kneaded in a continuous kneader. The kneaded mixture was finely pulverized with a jet pulverizer and classified with an air classifier. The thus obtained particles were subjected to a sphering treatment in a Turbo mill (manufactured by Turbo Kogyo K. K.), thereby obtaining toner particles having a volume-average particle size of 6 μm, a Dv/Dp ratio of 1.20 and a sphericity of 0.92. 100 Parts of the toner particles, 0.5 parts of hydrophobic silica and 0.5 parts of hydrophobized titanium oxide were mixed in a Henschel mixer to obtain a comparative toner (2). The toner binder of the comparative toner (2) had a main peak molecular weight Mp of 3800, a content of a component having an Mw of at least 30000 of 12%, an Mw/Mn ratio of 6, and a Tg of 58° C. The physical properties and the results of the evaluations of the toner are summarized in Tables 1-1 through 1-4 and Tables 2-1 and 2-2.

COMPARATIVE EXAMPLE 3

Comparative Example 2 was repeated in the same manner as described except that 10 parts of Carnauba wax was additionally mixed with 100 parts of the comparative toner binder (y) and 4 parts of a copper phthalocyanine blue pigment to obtain a comparative toner (3). The toner binder of the comparative toner (3) had a main peak molecular weight Mp of 3800, a content of a component having an Mw of at least 30000 of 12%, an Mw/Mn ratio of 6, and a Tg of 58° C. The physical properties and the results of the evaluations of the toner are summarized in Tables 1-1 through 1-4 and Tables 2-1 and 2-2.

TABLE 1-1

| Example No. | Modified Polyester (i) | Unmodified Polyester (ii) | (i)/(ii) | Mp |
|---|---|---|---|---|
| 1 | Urea-modified (1) | (a) | 10/90 | 5000 |
| 2 | Urea-modified (1) | (a) | 20/80 | 5000 |
| 3 | Prepolymer (3) | (a) | 10/90 | 5000 |
| 4 | Prepolymer (3) | (a) | 3/97 | 5000 |
| 5 | Prepolymer (3) | (a) | 50/50 | 5000 |
| 6 | Prepolymer (3) | (a) | 75/25 | 5000 |
| 7 | Prepolymer (3) | (a) | 85/15 | 5000 |
| 8 | Prepolymer (3) | (b) | 10/90 | 5000 |
| 9 | Prepolymer (3) | (c) | 10/90 | 5000 |
| 10 | Prepolymer (3) | (d) | 10/90 | 5000 |
| 11 | Prepolymer (3) | (e) | 10/90 | 5000 |
| 12 | Prepolymer (3) | (f) | 10/90 | 1000 |
| 13 | Prepolymer (3) | (g) | 10/90 | 2000 |
| 14 | Prepolymer (3) | (h) | 10/90 | 20000 |
| 15 | Prepolymer (3) | (i) | 10/90 | 30000 |
| 16 | Prepolymer (3) | (a) | 10/90 | 5000 |
| 17 | Prepolymer (3) | (a) | 10/90 | 5000 |
| 18 | Prepolymer (3) | (a) | 10/90 | 5000 |
| 19 | Prepolymer (3) | (a) | 10/90 | 5000 |
| 20 | Urea-modified (1) | (a) | 10/90 | 5000 |
| 21 | Polystyrene graft-modified polyester | (a) | 10/90 | 5000 |
| Comp. 1 | — | (x) | — | 5000 |
| Comp. 2 | Urethane-modified polyester | (y) | 35/65 | 3800 |
| Comp. 3 | Urethane-modified polyester | (y) | 35/65 | 3800 |

TABLE 1-2

| Example No. | Mw 30000 or greater (%) | Mw/Mn | Acid Value | Tg (° C.) | Wax (parts) |
|---|---|---|---|---|---|
| 1 | 5 | 3 | 10 | 62 | 5 |
| 2 | 6 | 3.5 | 10 | 65 | 5 |
| 3 | 5 | 3 | 10 | 62 | 5 |
| 4 | 3 | 2 | 10 | 62 | 5 |
| 5 | 8 | 3.5 | 10 | 62 | 5 |
| 6 | 9 | 4.5 | 10 | 62 | 5 |
| 7 | 10 | 5 | 10 | 62 | 5 |
| 8 | 5 | 3 | 0.5 | 62 | 5 |
| 9 | 5 | 3 | 2 | 62 | 5 |
| 10 | 5 | 3 | 25 | 62 | 5 |
| 11 | 5 | 3 | 35 | 62 | 5 |
| 12 | 4 | 4.5 | 10 | 45 | 5 |
| 13 | 5 | 4 | 10 | 52 | 5 |
| 14 | 6 | 2.5 | 10 | 69 | 5 |
| 15 | 7 | 2 | 10 | 73 | 5 |
| 16 | 5 | 3 | 10 | 62 | 0 |
| 17 | 5 | 3 | 10 | 62 | 10 |
| 18 | 5 | 3 | 10 | 62 | 30 |
| 19 | 5 | 3 | 10 | 62 | 50 |
| 20 | 5 | 3 | 10 | 62 | 0 |
| 21 | 5 | 3 | 10 | 62 | 5 |
| Comp.Ex.1 | 0.3 | 3 | — | 57 | 0 |
| Comp.Ex.2 | 12 | 6 | — | 58 | 0 |
| Comp.Ex.3 | 12 | 6 | — | 58 | 10 |

TABLE 1-3

| Example No. | Melt Viscosity at 110° C. (Ps · s) | Melt Viscosity at 130° C. (Ps · s) | Contact Angle (°) |
|---|---|---|---|
| 1 | 10,000 | 800 | 125 |
| 2 | 18,000 | 1,600 | 110 |
| 3 | 10,300 | 820 | 120 |
| 4 | 6,200 | 650 | 122 |
| 5 | 18,800 | 1,700 | 103 |
| 6 | 19,600 | 1,850 | 98 |
| 7 | 19,900 | 1,950 | 91 |
| 8 | 14,500 | 1,300 | 114 |
| 9 | 13,200 | 1,240 | 118 |
| 10 | 9,500 | 770 | 124 |
| 11 | 8,000 | 740 | 127 |
| 12 | 6,000 | 620 | 126 |
| 13 | 7,200 | 680 | 125 |
| 14 | 16,600 | 1,460 | 111 |
| 15 | 17,500 | 1,690 | 104 |
| 16 | 9,700 | 780 | 88 |
| 17 | 9,900 | 800 | 128 |
| 18 | 10,400 | 810 | 130 |
| 19 | 10,500 | 830 | 135 |
| 20 | 10,600 | 850 | 85 |
| 21 | 11,700 | 900 | 123 |
| Comp.1 | 5,000 | 700 | 84 |
| Comp.2 | 18,000 | 1,100 | 86 |
| Comp.3 | 18,200 | 1,140 | 128 |

TABLE 1-4

| Example No. | Number % of Wax Particles Diameter of 0.1–3 μm (%) | Volume Average Particle Size (μm) | Dv/Dp | Sphericity |
|---|---|---|---|---|
| 1 | 89 | 6 | 1.15 | 0.98 |
| 2 | 77 | 6 | 1.15 | 0.98 |
| 3 | 83 | 6 | 1.12 | 0.98 |
| 4 | 88 | 6 | 1.12 | 0.98 |
| 5 | 75 | 6 | 1.12 | 0.98 |
| 6 | 73 | 6 | 1.12 | 0.98 |
| 7 | 71 | 6 | 1.12 | 0.98 |
| 8 | 82 | 6 | 1.12 | 0.98 |

TABLE 1-4-continued

| Example No. | Number % of Wax Particles Diameter of 0.1–3 μm (%) | Volume Average Particle Size (μm) | Dv/Dp | Sphericity |
|---|---|---|---|---|
| 9 | 84 | 6 | 1.12 | 0.98 |
| 10 | 87 | 6 | 1.12 | 0.98 |
| 11 | 90 | 6 | 1.12 | 0.98 |
| 12 | 75 | 6 | 1.12 | 0.98 |
| 13 | 77 | 6 | 1.12 | 0.98 |
| 14 | 80 | 6 | 1.12 | 0.98 |
| 15 | 83 | 6 | 1.12 | 0.98 |
| 16 | — | 6 | 1.12 | 0.98 |
| 17 | 85 | 6 | 1.12 | 0.98 |
| 18 | 84 | 6 | 1.12 | 0.98 |
| 19 | 80 | 6 | 1.12 | 0.98 |
| 20 | — | 6 | 1.15 | 0.98 |
| 21 | 75 | 6 | 1.15 | 0.98 |
| Comp. 1 | — | 5 | 1.18 | 0.98 |
| Comp. 2 | — | 6 | 1.2 | 0.92 |
| Comp. 3 | 80 | 12 | 1.22 | 0.94 |

TABLE 2-1

| Example No. | Evaluation 1 | Evaluation 2 | Evaluation 3 | Evaluation 4 |
|---|---|---|---|---|
| 1 | 140 | 220 | 18 | 150 |
| 2 | 140 | 225 | 20 | 150 |
| 3 | 140 | 220 | 16 | 150 |
| 4 | 135 | 200 | 14 | 145 |
| 5 | 145 | 210 | 25 | 160 |
| 6 | 150 | 225 | 30 | 180 |
| 7 | 160 | 240 | 35 | 180 |
| 8 | 145 | 220 | 16 | 150 |
| 9 | 140 | 220 | 16 | 150 |
| 10 | 140 | 220 | 16 | 150 |
| 11 | 135 | 220 | 16 | 150 |
| 12 | 130 | 200 | 13 | 140 |
| 13 | 140 | 210 | 14 | 145 |
| 14 | 150 | 220 | 21 | 160 |
| 15 | 160 | 230 | 23 | 170 |
| 16 | 140 | 200 | 14 | 160 |
| 17 | 140 | 210 | 17 | 150 |
| 18 | 140 | 225 | 20 | 145 |
| 19 | 150 | 230 | 23 | 150 |
| 20 | 140 | 220 | 20 | 150 |
| 21 | 140 | 220 | 18 | 150 |
| Comp. 1 | 140 | 170 | 15 | 145 |
| Comp. 2 | 140 | 200 | 30 | 150 |
| Comp. 3 | 140 | 220 | 20 | 150 |

Remarks:
(1) Lowest fixing temperature (° C.)
(2) Highest non-hot offset temperature (° C.)
(3) Haze
(4) Gross developing temperature (° C.)

TABLE 2-2

| Example No. | Evaluation 5 | Evaluation 6 | Evaluation 7 | Evaluation 8 |
|---|---|---|---|---|
| 1 | B | B | A | A |
| 2 | B | B | A | A |
| 3 | B | B | A | A |
| 4 | B | C | A | A |
| 5 | B | B | A | A |
| 6 | B | B | A | A |
| 7 | B | A | A | A |
| 8 | B | B | A | A |
| 9 | B | B | A | A |
| 10 | B | B | A | A |
| 11 | B | B | A | A |
| 12 | B | C | A | A |
| 13 | B | B | A | A |

TABLE 2-2-continued

| Example No. | Evaluation 5 | Evaluation 6 | Evaluation 7 | Evaluation 8 |
|---|---|---|---|---|
| 14 | B | B | A | A |
| 15 | B | A | A | A |
| 16 | A | B | A | A |
| 17 | B | B | A | A |
| 18 | B | B | A | A |
| 19 | C | B | A | A |
| 20 | C | B | A | A |
| 21 | A | B | A | A |
| Comp. 1 | A | D | A | B |
| Comp. 2 | D | B | C | B |
| Comp. 3 | D | B | C | C |

Remarks:
(5) Powder fluidity; ranks A–C are acceptable
(6) Heat resistant preservability; ranks A–C are acceptable
(7) Transfer efficiency; ranks A and B are acceptable
(8) Filming; ranks A and B are acceptable

[Evaluation Method]

Glass Transition Point

As a device for measuring glass transition point (Tg), TG-DSC system TAS 100, manufactured by Rigaku Denki Kogyo K. K. was used.

About 10 mg of a sample is charged in an aluminum sample vessel, which is then placed on a holder unit and set in an electric furnace. The sample is heated from room temperature to 150° C. at a heating rate of 10° C./min and allowed to stand at 150° C. for 10 minutes. On cooling to room temperature, the sample is allowed to stand for 10 minutes. The sample is then heated again to 150° C. at a heating rate of 10° C./min in a nitrogen atmosphere and subjected to the DSC measurement. The Tg was calculated from a contact point between a tangent line of a heat-absorption curve in the vicinity of the Tg and a base line using an analysis system provided in TAS-100 system.

Melt Viscosity

The melt viscosity of the toner is measured using a commercially available flow tester of capillary type, "CFT-500", made by Shimadzu Corporation. A sample (1 $cm^3$) is placed in a cylinder of the tester, and the temperature is increased at a rate of 3° C./min. A pressure of 10 $kg/cm^2$ is applied to the sample so as to extrude the sample through a small orifice with a diameter of 0.5 mm in the die. The melt viscosity at 110° C. and 130° C. is measured.

Contact Angle to Water

A commercially available color copying machine (PRETER manufactured by Ricoh Company, Ltd.) modified to have a specific heating roller is used to form an image on an OHP sheet. The heating roller has a diameter of 60 mm and composed of a metal cylinder having an inside space provided with a heating source, an elastic layer (thickness: 2 mm) formed of a silicone rubber and covering the metal cylinder, and a releasing layer (thickness: 30 μm) formed of PFA (tetrafluoroethylene-perfluoroalkylvinyl ether copolymer) and coated over the outer surface of the elastic layer. Toner images are fixed under the following conditions:

Surface pressure: 5 $kg/cm^2$

Nip width: 7.5 mm

Nip time: 50 ms

Fixing temperature: 160° C.

Linear speed: 100 mm/s

Toner deposition amount: 0.8–1.2 $mg/cm^2$

A drop of ion-exchanged pure water is applied onto a sample image on the OHP sheet and the contact angle to water is measured with a contact angle measuring device (FACE manufactured by Kyowa Kaimen Kagaku K. K.).

Measurement is carried out for arbitrary five points of the image. An average of the five measured values represents the contact angle to water of the sample.

Molecular Weight Distribution of Toner

The molecular weight distribution of the toner binder is measured according to the following method. About 1 g of the toner is charged in an Erlenmeyer flask and 10 to 20 g of THF (tetrahydrofuran) is added thereto to prepare a THF solution having a binder concentration of 5 to 10%. A column is stabilized within a heat chamber set at 40° C., and THF as a solvent is passed through the column at this temperature at a rate of 1 ml/min. Then, 20 μl of the sample solution is injected into the column. The molecular weight of the sample is calculated from the relation between the logarithm of a calibration curve obtained using a monodispersion polystyrene standard sample and the retention time. As the monodispersion polystyrene standard sample, for example, a polystyrene having a molecular weight between $2.7\times10^2$ and $6.2\times10^6$ made by Toso Co., Ltd. is used. As a detection device, a refraction index (RI) detector is used. Examples of the column include TSK gel, G1000H, G2000H, G2500H, G3000H, G4000H, G5000H, G6000H, G7000H and GMH, products of Toso Co., Ltd. Those columns are used in combination.

Molecular Weight of Wax

The molecular weight of wax is measured similar to the above method of measuring the molecular weight of toner under the following conditions:

Measuring device: Tpe 150 CV manufactured by Waters Inc.

Column: Shodex AT-G+AT-806MS two columns

Eluate liquid: o-dichlorobenzene (containing 0.3% BHT)

Temperature: column and injector: 135° C.

Concentration: 0.15 wt %/vol %

Flow rate: 1.0 ml/min dissolution: completely dissolved

Detector: differential refractometer (RI)

Melting Point of Wax

Melting point is measured using THERMO FLEX Type 8110 manufactured by Rigaku Denki K. K. at a heating rate of 10° C./min. The main maximal peak of the endothermic curve represents the melting point.

Dispersion Diameter of Wax

The "dispersion diameter of wax particle" refers to the maximum length of a line extending between two points on the peripheral line of the TEM pattern of the particle. TEM pattern is obtained as follows. A sample toner is embedded in an epoxy resin and the embedded body is cut into a slice having a thickness of about 100 nm. The slice is dyed with ruthenium tetraoxide and a cross-sectional photograph (magnification: 10,000) is taken using a transmission electron microscope (TEM).

Particle Size of Toner

Coulter counter TA-II or Coulter Multisizer II (manufactured by Coulter Electronics Inc.) is used as the measuring apparatus.

0.1 to 5 Ml of a surfactant (preferably alkyl benzene sulfonate salt) is added as a dispersant to 100 to 150 ml of an electrolytic solution, which is an about 1% aqueous solution of NaCl prepared using a first-grade sodium chloride such as ISOTON-II (made by Coulter Scientific Japan Co.). 2 to 20 Mg of a sample is added to the aqueous solution. The electrolytic solution in which the sample is suspended is subjected to dispersion treatment for about 1 to 3 minutes using an ultrasonic disperser. The measuring apparatus measures the suspension for the volume and the number of the toner particles using an aperture having a diameter of 100 μm and calculates the volume distribution and the number distribution thereof. From the thus obtained distributions, the volume-average particle diameter (Dv) and the number-average particle diameter (Dp) of the toner particles can be obtained.

In the measurement, 13 channels, i.e., 2.00–2.52 μm; 2.52–3.17 μm; 3.17–4.00 μm; 4.00–5.04 μm; 5.04–6.35 μm; 6.35–8.00 μm; 8.00–10.08 μm; 10.08–12.70 μm; 12.70–16.00 μm; 16.00–20.20 μm; 20.20–25.40 μm; 25.40–32.00 μm; and 32.00–40.30 μm (the upper limit not included), are used and particles having a diameter of not smaller than 2.00 μm and less than 40.30 μm are measured.

Sphericity

A flow particle image analyzer, "FPIA-1000", manufactured by Toa Iyou Denshi K. K. is used for the measurement of sphericity of the toner particles and particles of the external additives.

A few droplets of a nonionic surfactant (preferably Contaminon N, made by Wako Pure Chemical Industries, Ltd.) is added to water, which has been passed through a filter to remove fine dust and thus contains 20 or less particles having a diameter within the measurement range (a circle-equivalent diameter of not smaller than 0.60 to less than 159.21 μm, for example) per $10^{-3}$ $cm^3$. To the water, 5 mg of a sample is added. This is subjected to a dispersion treatment for 1 minute under conditions of 20 kHz and 50 W/10 $cm^3$ with an ultrasonic disperser UH-50, manufactured by K. K. SMT and then subjected to a dispersion treatment for 5 minutes in total to form a sample dispersion liquid having a concentration of 4000 to 8000 particles/$10^{-3}$ $cm^3$ (based on particles having a circle-equivalent diameter within the measurement range). The sample dispersion liquid is measured for a particle size distribution of particles having a circle-equivalent diameter in a range from not smaller than 0.60 μm to less than 159.21 μm using the above flow type particle image analyzer.

The sample dispersion liquid is passed through a channel (extending along the flow direction) of a flat transparent flow cell (thickness: about 200 μm). A strobe and a CCD camera are disposed at positions opposite to each other with respect to the flow cell to form a light path passing across the thickness of the flow cell. While the sample dispersion liquid is flowing, the strobe is flashed at intervals of 1/30 second to capture images of particles passing through the flow cell, whereby each particle is captured as a two-dimensional image having a certain area parallel to the flow cell. From the area of the two-dimensional image of the particle, a diameter of a circle having the same area is calculated as a circle-equivalent diameter of the particle.

For about one minute, more than 1200 particles can be measured for a circle-equivalent diameter, whereby the number of particles based on a circle-equivalent diameter distribution and a proportion (% by number) of particles having a specified circle-equivalent diameter can be determined. The result (frequency % and cumulative %) can be given in such a manner that the range from 0.06 μm to 400 μm is divided into 226 channels (divided into 30 channels for one octave). In actual measurement, particles are measured within the circle-equivalent diameter range from 0.60 μm to less than 159.21 μm.

Evaluation methods the results of which are shown in Tables 2-1 and 2-2 are as follows:

Lowest Fixing Temperature and Highest Non-Offset Temperature

A copying machine, Preter 550, manufactured by Ricoh Company, Ltd., was adjusted to develop 1.0±0.1 mg/$cm^2$ of a toner and modified such that the spring pressure was increased so that the nip width might be 1.6 times and the fixing temperature was variable. The temperature of the fixing roller was changed by 5° C. at a time and the toner was measured for its highest non-hot offset temperature (the highest temperature at which hot offset did not occur). As a transfer paper, Type 6000-70W made by Ricoh Company, Ltd. was used. The linear speed of the fixing unit was 180±2 mm/sec, and the fixing nip width was 10±1 mm.

Haze, as Substitute for Transparency

A copying machine, Preter 550, manufactured by Ricoh Company, Ltd., was adjusted to develop 1.0±0.1 mg/cm$^2$ of a toner and modified such that the spring pressure was increased so that the nip width might be 1.6 times. Using an OHP sheet (Type PPC-DX, made by Ricoh Company, Ltd.) as a transfer paper, an image was printed out in OHP mode when the surface temperature of the fixing roller was 160° C. The haze of the printed image was measured with an automatic haze computer, HGM-2DP, manufactured by Suga Test Instruments Co., Ltd.

The haze, which is referred to as clouding degree, is used as a measure for representing transparency of a toner, and the lower the value, the higher the transparency. With a toner having a low haze, an image can be produced on an OHP sheet with high color developability, and colors of lower layers of laminated toner layers are developed well, so that an image can be produced with a wide color reproduction range. In order to obtain excellent color developbility, the haze is preferably not greater than 30%, more preferably not greater than 20%.

Gloss Developing Temperature

A copying machine, Preter 550, manufactured by Ricoh Company, Ltd., was adjusted to develop 1.0±0.1 mg/cm$^2$ of a toner and modified such that the spring pressure was increased so that the nip width might be 1.6 times. The gloss of a fixed image sample was measured with a glossmeter (manufactured by Nippon Denshoku Kogyo Co., Ltd.) with an incident angle of 60°. As a transfer paper, Type 6000-70W made by Ricoh Company, Ltd. was used. The higher the value is, the higher the gloss of the image is. In order to obtain a clear image with high color reproducibility, a toner should have a gloss of at least about 10%. A fixing roll temperature at which the gloss of a fixed image as measured with an incident angle of 60° reached 10% or higher was defined as the gloss developing temperature of the toner.

Powder Fluidity

The static apparent density of the toner was measured with a powder tester manufactured by Hosokawa Micron Co., Ltd. The larger the static apparent density is, the better the fluidity of the toner is. The results were graded according to the following four levels.

| | |
|---|---|
| A: Excellent | 0.35 or higher |
| B: Good | 0.30 to 0.35 |
| C: Fair | 0.25 to 0.30 |
| D: No good | Less than 0.25 |

Heat-Resistant Preservability

20 Grams of a toner sample charged in a 20 ml glass vessel was tapped about 50 times and tightly solidified. This was then allowed to stand in a thermostatic chamber at 50° C. for 24 hours. Then, needle penetration degree of the solidified toner was measured using a needle penetration tester.

| | |
|---|---|
| A: Excellent | Penetrated |
| B: Good | 25 mm or greater |
| C: Fair | 15 to 25 mm |
| D: No good | Less than 15 mm |

Transfer Efficiency

A chart containing complicated Japanese kanji letters (19 letters in one line, 10 points, Mincho font) is copied to a post card. "Worm eaten" portions are counted for evaluation of transfer efficiency according to the following ratings:

A: Good

B: Fair

C: No good

Filming

The photoconductor is observed for occurrence of filming and evaluated according to the following ratings:

A: No filming

B: Slight filming

C: Significant filming

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Applications No. 2001-290141 filed Sep. 21, 2001 and No. 2001-095527 filed Mar. 29, 2001, inclusive of the specifications, claims and drawings, are hereby incorporated by reference herein.

What is claimed is:

1. A process comprising dissolving or dispersing a toner composition comprising a polyester-containing prepolymer and a colorant in an organic solvent to prepare a liquid, dispersing said liquid in an aqueous medium in the presence of at least one of an inorganic dispersant or a powdery polymer to obtain a dispersion, subjecting said dispersion to a polyaddition reaction to polymerize said prepolymer and to obtain a reaction mixture; and removing the solvent from said reaction mixture to obtain a dry toner comprising a modified polyester having a molecular weight distribution according to gel permeation chromatography wherein (a) a main peak is present in a molecular weight region of 1000 to 30,000, (b) that portion of the modified polyester having a molecular weight of at least 30,000 accounts for 1 to 10% based on a total weight of the modified polyester, and (c) a ratio (Mw/Mn) of the weight average molecular weight Mw of the modified polyester to the number average molecular weight Mn of the modified polyester is not smaller than 2 but not greater than 15.

2. The process as claimed in claim 1, wherein said prepolymer is an isocyanate group-containing polyester prepolymer, and wherein said dispersion further comprises an amine.

3. The process as claimed in claim 1, wherein the modified polyester is at least one selected from the group consisting of an amine-modified polyester, an acryl-modified polyester, a styrene-modified polyester, a silicone-modified polyester.

4. The process as claimed in claim 1, wherein the modified polyester is prepared by:

reacting a polyol and a polyacid in the presence of an esterification catalyst to form a hydroxyl group-containing polyester, reacting the hydroxyl group-containing polyester with a polyisocyanate at from 40 to 140° C. to obtain a prepolymer, reacting the prepolymer with an amine at from 0 to 140° C. to obtain the modified polyester.

5. The process as claimed in claim 4, wherein the polyol and the polyacid are reacted in the presence of tetrabutoxytitantate or dibutyl tin oxide.

6. The process as claimed in claim 4, wherein the reaction of the polyol and polyacid is carried out under reduced pressure while removing water.

7. The process as claimed in claim 4, wherein the reaction of the polyol and the polyacid is carried out in the presence of a solvent.

8. The process as claimed in claim 4, wherein the prepolymer is reacted with the amine in the presence of a solvent.

9. The process as claimed in claim 8, wherein the solvent is at least one selected from the group consisting of aromatic solvents, ketones, esters, amides, and ethers.

10. The process as claimed in claim 8, wherein the solvent is selected from the group consisting of toluene, xylene, methylethylketone, methylisobutylketone, ethylacetate, dimethylformamide, dimethylacetamide, and tetrahydrofuran.

11. The process as claimed in claim 1, further comprising mixing the dry toner with at least one of a coloring agent, wax or charge controlling agent to obtain a mixture.

12. The process as claimed in claim 11, further comprising kneading the mixture.

13. The process as claimed in claim 12, further comprising solidifying the kneaded mixture, then grinding the solidified mixture.

14. An image forming method comprising transferring a toner image carried by a toner image carrier to an image receiving member, and cleaning residual toner remaining on said toner image carrier with a blade, wherein said toner is obtained by the process according to claim 1.

* * * * *